US010823527B2

(12) United States Patent
Tino et al.

(10) Patent No.: US 10,823,527 B2
(45) Date of Patent: Nov. 3, 2020

(54) TOY LAUNCHER APPARATUS WITH FEW PARTS AND QUICK AND EASY ASSEMBLY

(71) Applicant: Hasbro, Inc., Pawtucket, RI (US)

(72) Inventors: Nicholas Alexander Tino, Burbank, CA (US); Ho Fai So, Ma Wan (HK)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 16/821,731

(22) Filed: Mar. 17, 2020

(65) Prior Publication Data

US 2020/0300576 A1 Sep. 24, 2020

Related U.S. Application Data

(60) Provisional application No. 62/822,174, filed on Mar. 22, 2019.

(51) Int. Cl.
*F41B 11/642* (2013.01)
*F41B 11/723* (2013.01)
*F41B 11/89* (2013.01)

(52) U.S. Cl.
CPC ..... *F41B 11/723* (2013.01); *F41B 11/642* (2013.01); *F41B 11/89* (2013.01)

(58) Field of Classification Search
CPC ..... F41B 11/64
USPC ..... 124/64, 66, 67
See application file for complete search history.

(56) References Cited

U.S. PATENT DOCUMENTS 1,441,975 A 1/1923 Edelin
1,488,995 A 4/1924 McCollom
2,737,942 A 3/1956 Horowitz et al.
3,054,536 A 9/1962 Sagarin
3,420,133 A 1/1969 Proll
3,990,426 A 11/1976 Stokes
4,841,945 A 6/1989 Braden
4,890,404 A 1/1990 Ferri
5,471,967 A 12/1995 Matsuzaki et al.
5,529,050 A 6/1996 D'Andrade
6,428,384 B1 8/2002 Su
6,488,019 B2 12/2002 Kotsiopoulos
7,051,727 B2 5/2006 Wu
(Continued)

OTHER PUBLICATIONS

PCT/US20/23293 ISR Transmittal, Written Opinion, and ISA Search 1-740 PCT papers dated Jun. 26, 2020.
(Continued)

*Primary Examiner* — Reginald S Tillman, Jr.
(74) *Attorney, Agent, or Firm* — Perry Hoffman

(57) ABSTRACT

A dart launcher having few but integral parts and an assembly process that is quick and easy for forming robust but inexpensive toys. The launcher may have an outer body, a safety valve and spring, a valve cap, a trigger, a piston, a launch spring, a cylinder cap and a plunger rod. The outer body includes an integral cylinder portion, a barrel portion and a trigger-mounting portion, the trigger includes an integral finger pad portion, a latch arm, a biasing portion and resilient legs. The piston includes an opening and a connector component formed around the opening to snap-fit with the piston, the cylinder cap includes an opening for the plunger rod and a connector component to connect with the cylinder portion, and the barrel portion includes a valve and mandrel support for supporting the safety valve and spring.

20 Claims, 22 Drawing Sheets

(56) References Cited

U.S. PATENT DOCUMENTS

| | | | | |
|---|---|---|---|---|
| 7,481,209 | B1 | 1/2009 | Bligh et al. | |
| 8,082,909 | B2 | 12/2011 | Sopinsky et al. | |
| 8,127,753 | B1 | 3/2012 | Brooks et al. | |
| 8,397,705 | B2 | 3/2013 | DeHaan et al. | |
| 8,567,378 | B2 | 10/2013 | Nugent | |
| 8,695,579 | B2 | 4/2014 | Huebl | |
| 8,875,688 | B2 | 11/2014 | Nugent | |
| 9,389,042 | B1 | 7/2016 | Clayton | |
| 9,958,230 | B1 | 5/2018 | Nugent et al. | |
| 2002/0166551 | A1 | 11/2002 | Lee | |
| 2007/0283941 | A1 | 12/2007 | Tai et al. | |
| 2009/0095272 | A1 | 4/2009 | Zimmerman | |
| 2010/0206281 | A1 | 8/2010 | Kanitz et al. | |
| 2013/0112184 | A1 | 5/2013 | Corsiglia et al. | |
| 2013/0118465 | A1 | 5/2013 | Nugent | |
| 2013/0239938 | A1 | 9/2013 | Nugent | |
| 2013/0239939 | A1 | 9/2013 | Nugent | |
| 2013/0312722 | A1 | 11/2013 | Price | |
| 2015/0044935 | A1* | 2/2015 | Fakonas ..... | A63H 33/22 446/71 |
| 2015/0083101 | A1 | 3/2015 | Nugent | |
| 2017/0328671 | A1 | 11/2017 | Liao | |

OTHER PUBLICATIONS

Hasbro updated their stinger from having a traditional jolt air-restrictor spring to a plastic air-restrictor spring. (More of the changes/updates to the stinger are in the comments) (U/CAPPYCOPPER) Nov. 8, 2019 (Nov. 8, 2019), [online] < URL:https://www.reddit.comlr/Nerf/comments/dtffih/hasbro _updated_their_stinger _from_having_a! >.

* cited by examiner

TOY LAUNCHER APPARATUS WITH FEW PARTS AND QUICK AND EASY ASSEMBLY

PRIORITY CROSS-REFERENCE TO RELATED APPLICATIONS

This application claims priority pursuant to 35 U.S.C. 119(e) from U.S. Provisional Patent Application No. 62/822,174 filed on Mar. 22, 2019.

FIELD OF THE INVENTION

The present invention relates generally to toy launcher apparatus and, more particularly, to toy dart launchers having few but integral parts and an assembly process that is quick and easy.

BACKGROUND OF THE INVENTION

Various toy and game launchers using high-pressure air are known in the art, as exemplified by U.S. Pat. No. 1,441,975 issued in 1923, U.S. Pat. No. 1,488,995 issued in 1924, and, more recently, U.S. Pat. Nos. 8,397,705 and 8,567,378, both issued in 2013, and U.S. Pat. No. 8,875,688 issued in 2014. Also, various valves and triggers are known in the art, including safety valves, exemplified by U.S. Pat. No. 3,054,536 issued in 1962, U.S. Pat. No. 3,420,133 issued in 1969, U.S. Pat. No. 5,529,050 issued in 1996, and Patent Application Publication 2010/0206281, published in 2010.

SUMMARY OF THE INVENTION

The inventive toy dart launcher is simply constructed with few and relatively inexpensive parts, and yet the toy launcher is structurally robust. Moreover, because of the few parts, the toy dart launcher may be easily snapped together. One of the integral parts is a trigger that includes a trigger pull, a return spring, a piston latch and snap-fit pivot shafts. Another part is an integral outer body that includes two parallel panels with openings for receiving the trigger, a cylinder and a barrel, and in the barrel, a Y-shaped element that mounts a mandrel. A safety valve and spring is another integral part of the toy dart launcher that includes a valve plate and three extending fingers, a spring and a base that is received into the barrel and may be restrained against rotation. Yet another part is a one-piece piston that includes an opening and resilient tabs around the opening to snap-fit with an upper end of a plunger rod. Another part of the launcher is a cylinder cap with an opening for the plunger rod and protrusions that are received by sockets molded with the cylinder of the outer body such that a slight twist or an inline snap-fit connects the cylinder cap to the outer body. Another snap-fit component on the outer body may be used to connect a decorative shell to the top of the outer body. The result of these arrangements is a very inexpensive toy with great play value.

Briefly summarized, the invention relates to a toy dart launcher apparatus including an outer body having an integral cylinder portion, a barrel portion and a trigger-mounting portion, the barrel portion including a valve and mandrel support, a safety valve and spring having an integral dart contacting portion, a valve plate portion, a spring portion and a base portion, the safety valve and spring being mounted in the barrel portion of the outer body and supported by the valve and mandrel support, the safety valve and spring being movable by a dart loaded in the barrel portion, a valve cap secured to the barrel portion of the outer body, a trigger having an integral finger pad portion, a latch arm portion, a biasing spring portion, and opposing pivot shafts mounted on resilient legs, the trigger being pivotally connected to the trigger-mounting portion of the outer body, a cylinder cap having an opening for a plunger rod and a connector component for engaging a connector component of the cylinder portion of the outer body, a plunger rod having a handle at one end and a connector component at an opposite end, the plunger rod extending through the opening of the cylinder cap, a piston with an opening and a connector component around the opening, the connector component of the piston to enable the piston to interlock with the connector component of the plunger rod, and a launch spring mounted around the plunger rod, the launch spring being seated between the cylinder cap and the piston.

The invention also relates to a method for assembling a toy dart launcher apparatus including the steps of providing an outer body, an integral safety valve and spring, a valve cap, a trigger, a piston, a launch spring, a cylinder cap and a plunger rod, wherein the outer body includes an integral cylinder portion, a barrel portion and a trigger-mounting portion, the trigger includes an integral finger pad portion, a latch arm, a biasing portion and resilient legs, the plunger rod includes a connector component, the piston includes an opening and a connector component formed around the opening, the cylinder cap includes an opening and a connector component, the plunger rod includes a connector component at one end, the barrel portion includes a valve and mandrel support, and each resilient leg includes an integral pivot shaft, sliding the plunger rod through the opening in the cylinder cap, sliding the launch spring over the plunger rod to seat in the cylinder cap, connecting the piston connector component and the plunger rod connector component, inserting a sub-assembly of the piston, the launch spring, and the plunger rod into the cylinder portion of the outer body, connecting the cylinder cap connector component and the connector component of the cylinder portion, inserting the integral safety valve and spring into the barrel portion of the outer body, connecting the valve cap to the barrel portion of the outer body, flexing the legs of the trigger, and engaging the pivot shafts of the trigger with the trigger-mounting portion of the outer body.

BRIEF DESCRIPTION OF THE DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
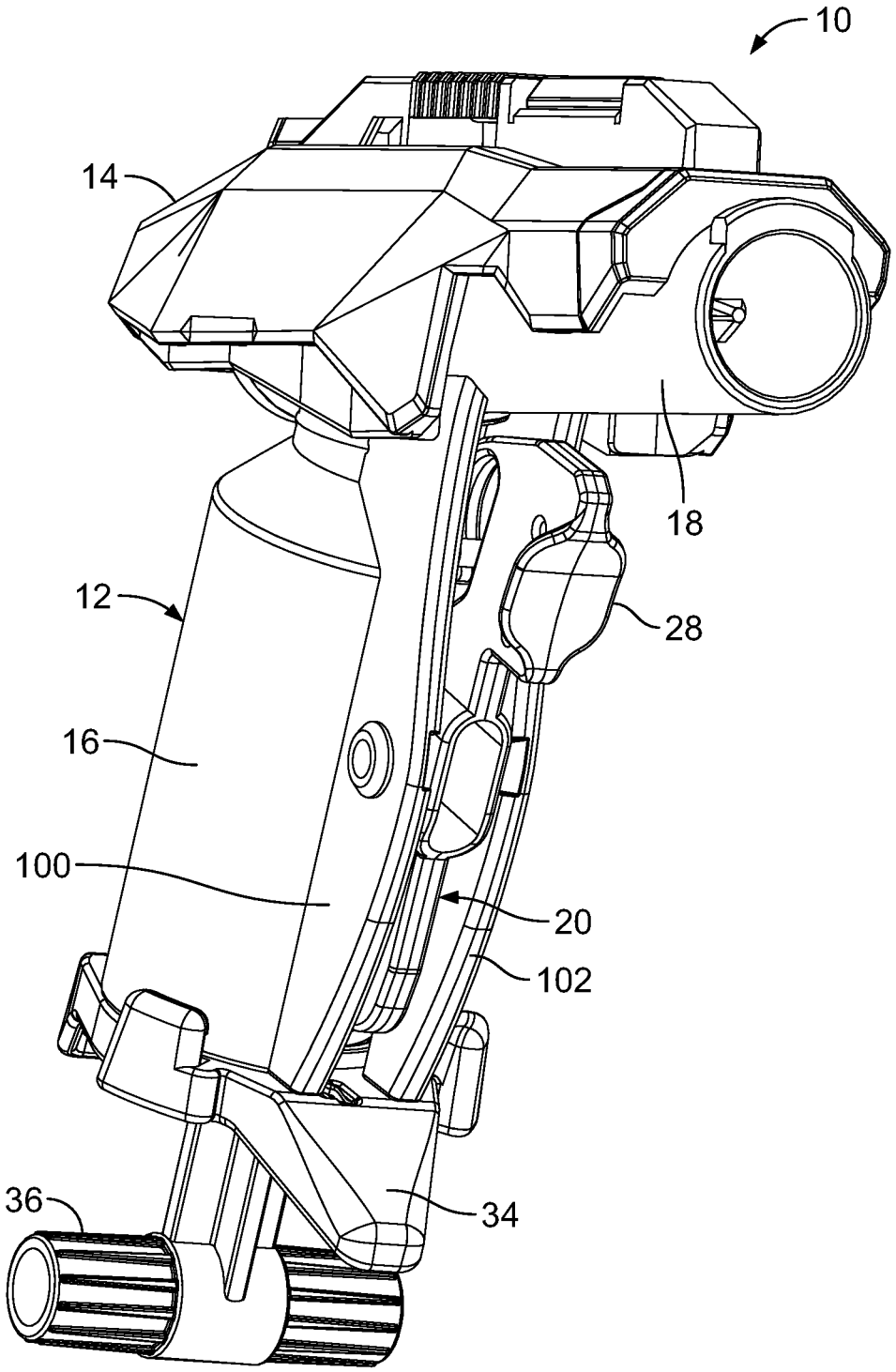
FIG. 1 is an isometric view of one embodiment of the inventive toy launcher apparatus in the form of a single-shot gun.
Figure 2:
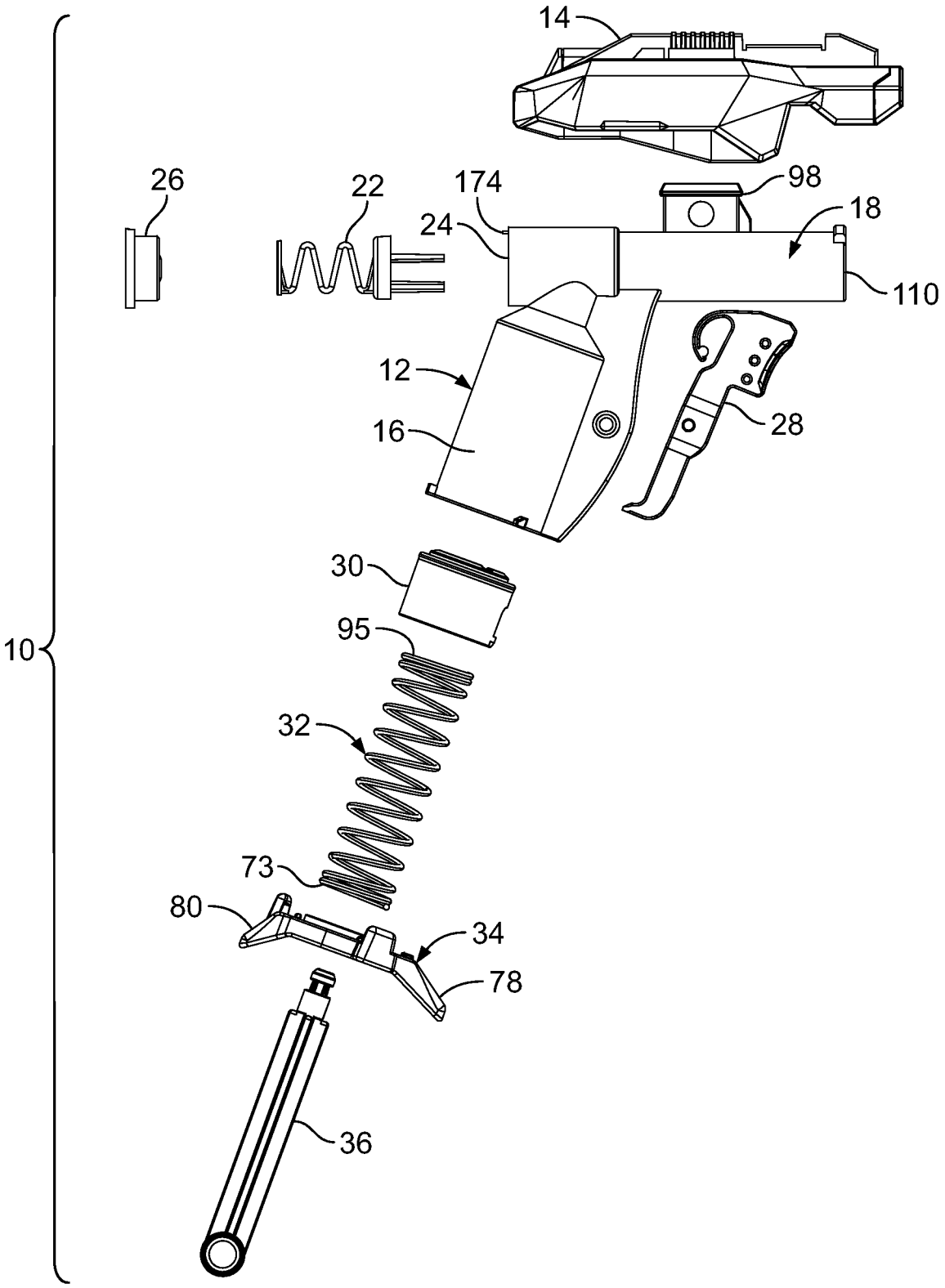
FIG. 2 is an exploded elevation view of the toy launcher illustrated in FIG. 1.

Referring now to FIGS. 1 and 2, the inventive toy apparatus may take the form of a small toy dart launcher or blaster 10, having few parts that are made of moldable plastic and that may be relatively inexpensive and easily and quickly assembled. The parts include an outer body 12 that may be covered with a top shell 14. The outer body 12 includes an integral cylinder portion 16, a barrel portion 18, and a trigger-mounting portion 20, and may also have a connector component, that is, one of two components that make up a connector that fastens two parts together. The parts also include an integral safety valve and spring 22 mounted toward the rearward end 24 of the barrel portion 18, and a valve cap 26 securing the safety valve and spring 22 in the barrel portion 18. The valve cap may also be used to prevent rotation of the integral safety valve and spring. Other parts of the launcher 10 are an integral trigger 28 mounted to the body trigger-mounting portion 20, a piston 30, a launch spring 32, a cylinder cap 34 and a plunger rod 36. The plunger rod, the launch spring and the piston form a sub-assembly mounted in the cylinder portion 16 of the outer body 12, where the sub-assembly is secured to the cylinder portion by the cylinder cap.

Figure 3:
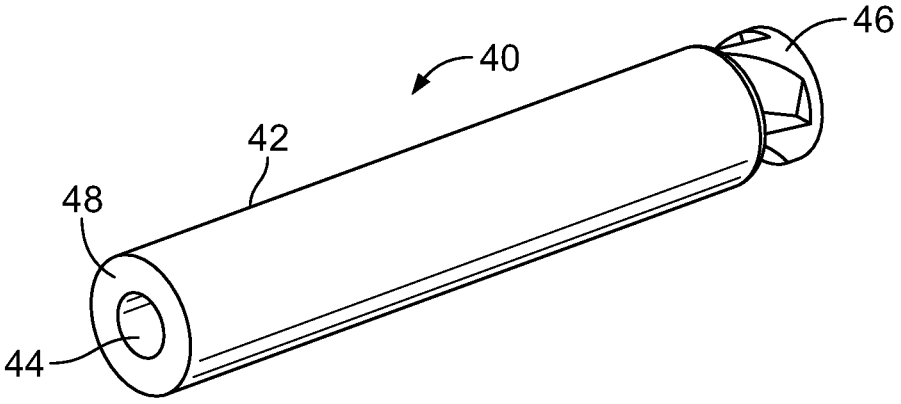
FIG. 3 is an isometric view of a soft foam dart.
Figure 4:
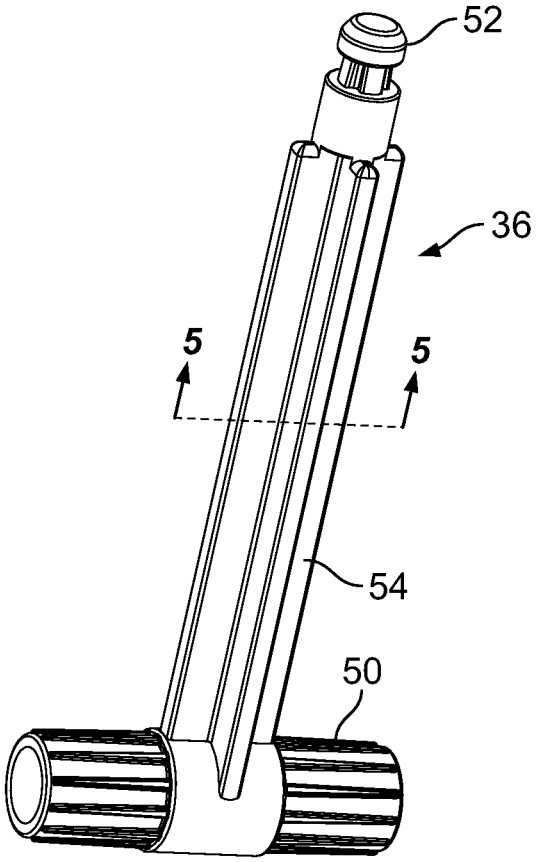
FIG. 4 is an enlarged isometric view of a plunger rod of the toy launcher illustrated in FIGS. 1 and 2.

The toy launcher 10 is designed to eject soft foam darts 40, FIG. 3, marketed under the NERF® brand. The NERF brand darts include a cylindrical body 42 having an open tubular center 44, a nose 46 and a ring-shaped rear wall 48. The launcher 10 operates in a similar manner to the launcher disclosed in the above-mentioned U.S. Pat. No. 8,875,688.

Figure 5:
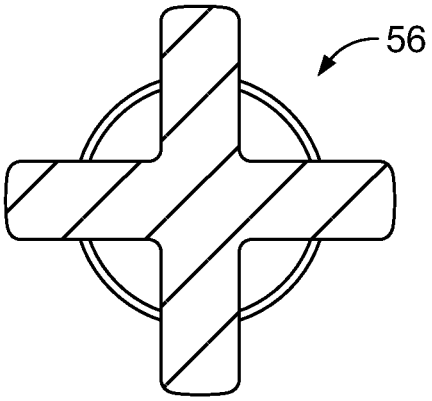
FIG. 5 is an enlarged cross-section view taken along line 5-5 of FIG. 4.
Figure 6:
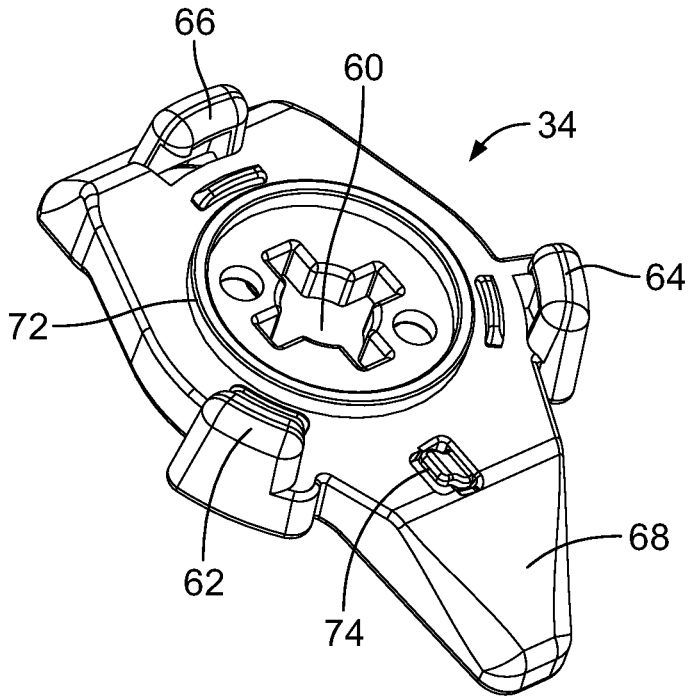
FIG. 6 is an isometric view of a twist-connect cylinder cap of the toy launcher illustrated in FIGS. 1 and 2.
Figure 7:
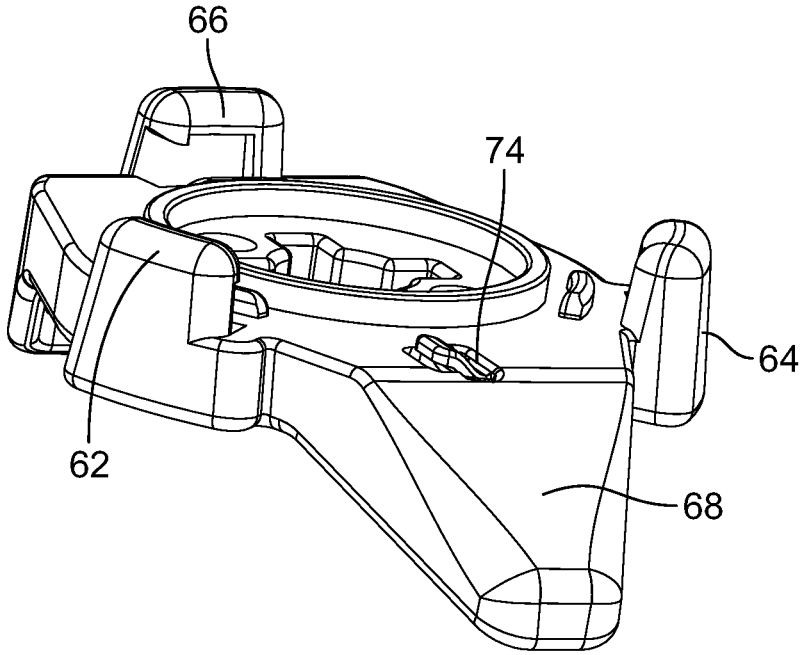
FIG. 7 is another isometric view of the cylinder cap shown in FIG. 6.
Figure 8:
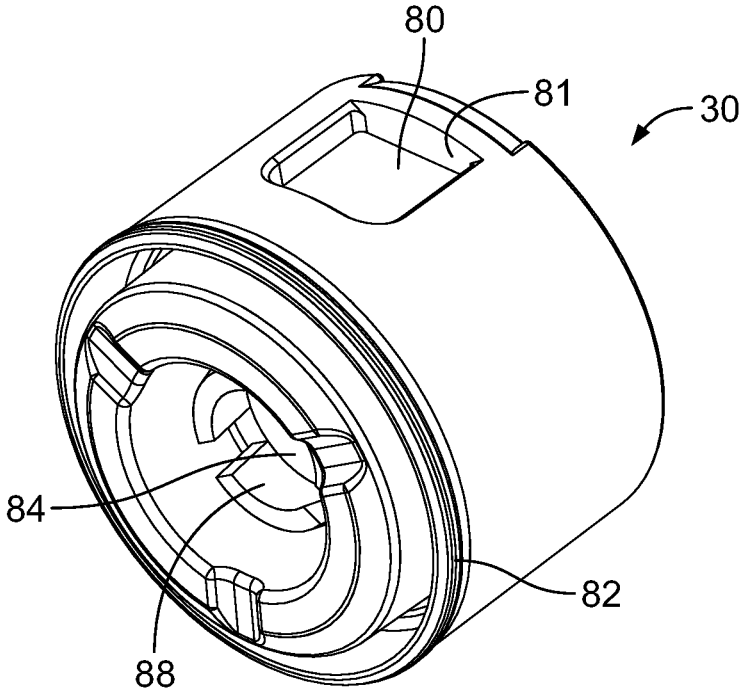
FIG. 8 is an enlarged isometric view of a piston of the launcher illustrated in FIGS. 1 and 2.
Figure 9:
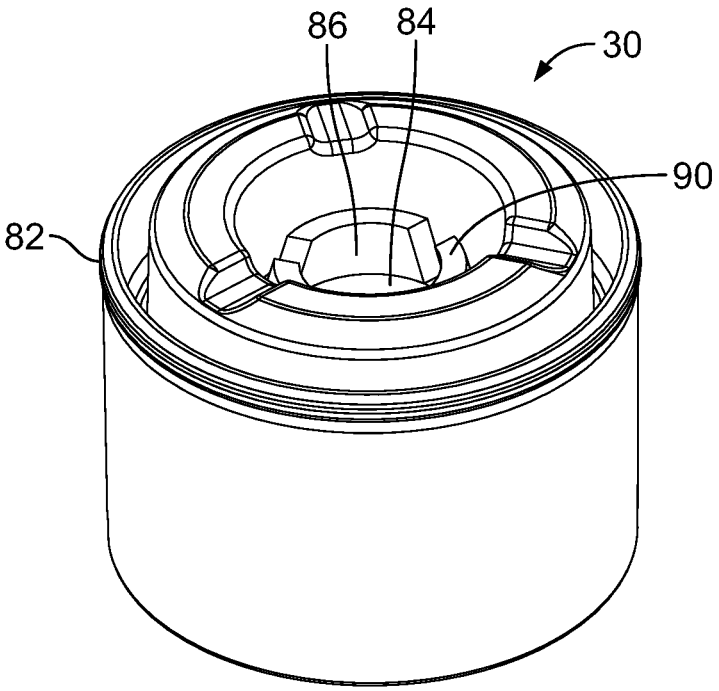
FIG. 9 is a downward-looking isometric view of the piston shown in FIG. 8.
Figure 10:
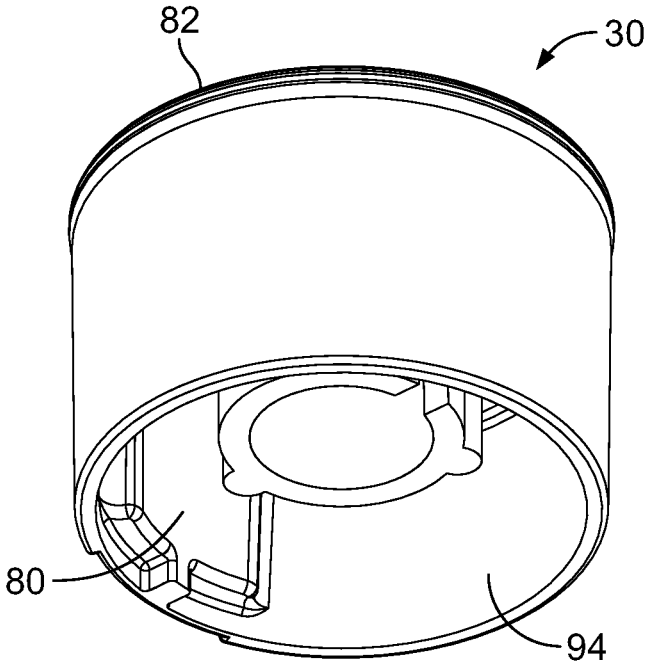
FIG. 10 is an upward-looking isometric view of the piston shown in FIGS. 8 and 9.
Figure 11:
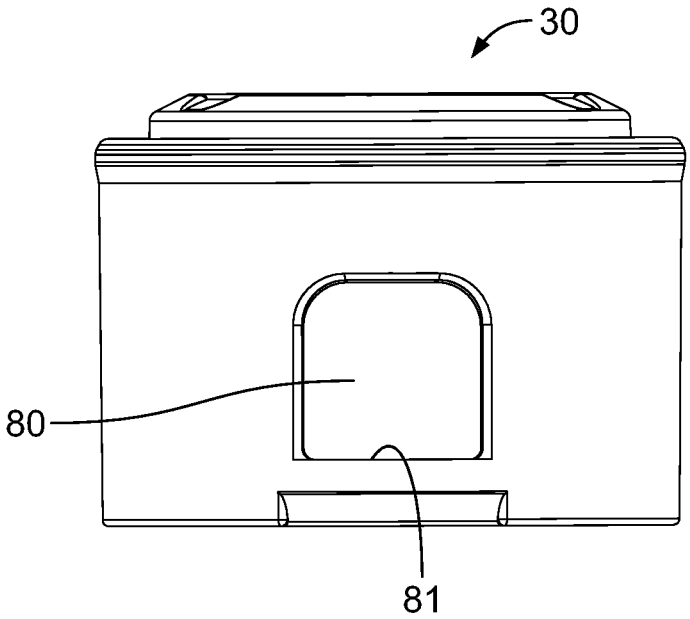
FIG. 11 is an elevation view of the piston shown in FIGS. 8-10.

The plunger rod 36, FIGS. 1, 2, 4 and 5, includes a T-shaped handle 50 at a first or lower end and a knob-like connector component 52 at a second or upper end. Between the handle 50 and the connector 52 is an elongated rod 54 having a cross-shaped, cross-section 56, as illustrated in FIG. 5. The cylinder cap 34, FIGS. 6 and 7, includes a cross-shaped opening 60 for receipt of the plunger rod 36 in a sliding engagement, three spaced-apart connector components formed as sockets 62, 64, 66 for engaging the cylinder portion of the outer body 12, a forward depending lip 68 and a rearward depending lip 70, FIG. 2. The cylinder cap 34 may also include a circular ridge 72 for seating a first or lower end 73 of the launch spring 32, and a tab 74 to hinder rotation of the cylinder cap 34 once the cap is connected to the outer body 12.

The piston 30, FIGS. 8-11 is a single molded, generally cup-shaped part with a recess 80 and a ledge 81 for engagement by the trigger 28, FIG. 2, a sealing ring portion 82 for forming a seal with the interior wall of the cylinder portion 16 of the outer body, and a top opening 84 with flexible tab connector components 86, 88, 90 for receiving and interlocking the knob connector component 52 of the plunger rod 36 in what is commonly referred to as a snap-fit. (The term 'snap-fit' used here may be defined to mean an assembly method used to connect two parts when the two parts are pushed together.) The interior 94 of the cup-shape piston forms a seat for the second or upper end 95 of the main spring 32. The piston may be made as a single molded component to minimize cost and make assembly with the plunger 36, FIG. 2, quicker and easier. All of the parts of the launcher 10, except for the launcher spring 32, are molded plastic and connected together with snap-fit connectors.

The launch spring 32, FIG. 2, may be a helical coil of steel seated between the piston 30 and the cylinder cap 34. In the alternative, the launch spring may be formed of plastic if found suitable. The sub-assembly of a plunger rod 36, a cylinder cap 34, a launch spring 32 and a piston 30 is inexpensive, but robust, and easy to assemble with the cylinder portion, and then to assemble with the remaining parts of the launcher. The individual integrally molded parts: the piston, the plunger rod, and the cylinder cap, are formed of a suitable plastic, such a polyethylene, HIPS, ABS or POM. In operation, when a user pulls outward on the plunger rod, the connected piston compresses the launch spring 32 against the cylinder cap. When a dart is launched, the air above the piston in the cylinder portion 16 quickly enters the barrel portion 18 behind the dart to cause discharge.

The outer body 12, FIGS. 1, 2, 12 and 13, of the toy launcher is also formed of a suitable plastic and may include an upper snap-fit connector component 98 to connect to the top shell 14. The outer body, as mentioned, includes the integral cylinder portion 16, the barrel portion 18, and the trigger-mounting portion 20. The trigger-mounting portion 20 may take the form of a pair of spaced-apart, parallel panels 100, 102, FIG. 13, where each panel includes an opening 104, 106 that defines a pivot axis for the trigger. Two grooves 103, 105 lead from the openings 104, 106 to the forward edges 108, 109 of the panels 100, 102 to facilitate a snap-fit of the trigger 28 and the outer body 16.

The barrel portion 18, FIG. 2, is sealed at a rearward end 24 with the valve cap 26 and receives NERF brand darts, one at a time, inserted by a user at a forward end 110. The barrel portion 18 includes an internal valve support ring 112, FIG. 12, for supporting the integral safety valve and spring 22. The support ring 112 includes an integral Y-shaped element 114 with openings 116, 118, 120. The Y-shaped element 114 is integral with an extended mandrel 122, FIG. 13, to which the dart is mounted when the user loads a dart into the launcher. A ridge 123 located between the parallel panels 100, 102 is molded with the outer body to engage the trigger 28 when the user pulls on the trigger.

Figure 13:
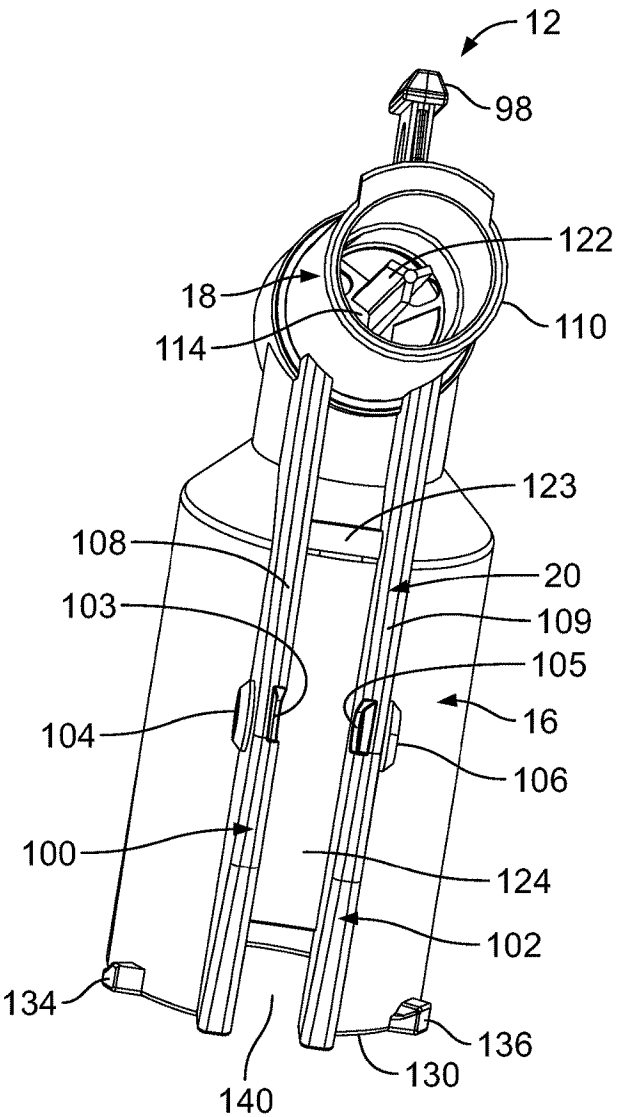
FIG. 13 is an isometric view of the front of the outer body illustrated in FIG. 12.
Figure 12:
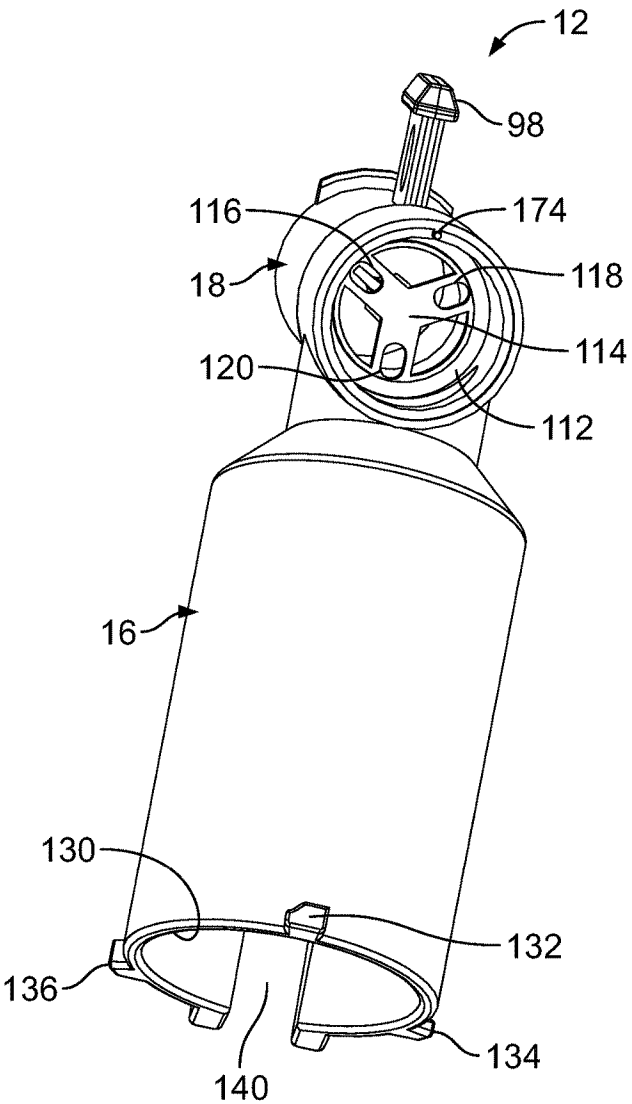
FIG. 12 is an isometric view of the rear of an integral outer body of the launcher illustrated in FIGS. 1 and 2.

The cylinder portion 16, FIGS. 12 and 13, of the integral outer body 12 is generally tubular in shape. The trigger-mounting portion 20 extends forward and is formed by the spaced-apart panels 100, 102. Between the panels is an opening 124 where the trigger 28 is received. At a lower end 130 of the cylinder portion 16 are three connector components in the form of protrusions 132, 134, 136 that engage and are received by the connector sockets 62, 64, 66, FIGS. 6 and 7, of the cylinder cap 34. The sockets 62, 64, 66 and the protrusions 132, 134, 136 attach by a simple twist motion to create an interference fit. (An 'interference fit' may be defined here as a fastening between two parts which is achieved by friction after the parts are brought together.) A notch 140 is located between the panels 100, 102 at the lower end 130 of the cylinder portion 16 to receive the tab 74 of the cylinder cap 34 to prevent rotation of the cylinder cap.

Figure 14:
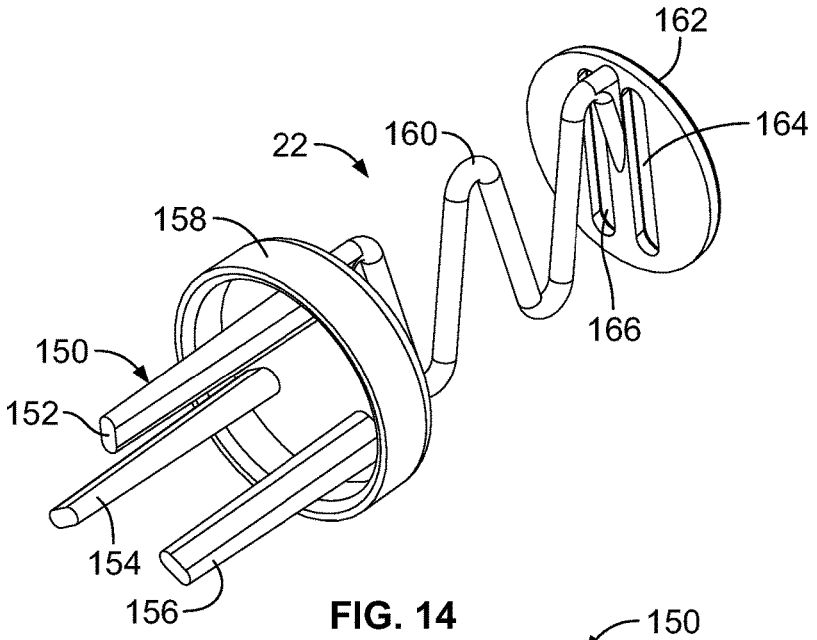
FIG. 14 is an enlarged isometric view of the front of an integral safety valve and spring of the launcher illustrated in FIGS. 1 and 2.
Figure 15:
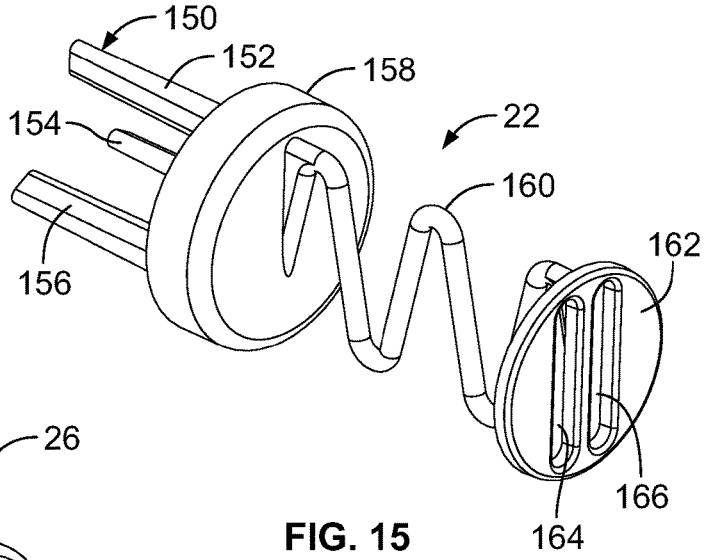
FIG. 15 is an isometric view of the rear of the integral safety valve and spring illustrated in FIG. 14.

The safety valve and spring 22, FIGS. 14 and 15, is an integral component formed of a suitable plastic and includes at a forward end, a dart contacting extender portion 150 in the form of three fingers 152, 154, 156 adapted to slide within and be supported in the three openings 116, 118, 120, FIG. 12, of the Y-shaped element 114 in the barrel portion 18 of the outer body 12. The extending fingers 152, 154, 156, FIG. 15, are positioned to enable engagement by the rear wall 48, FIG. 3, of a loaded dart. Rearward of the three fingers is a cup-shaped valve plate portion 158 that moves between closed and open positions.

After a dart is loaded, the valve portion 158 is pushed rearward in the barrel causing high pressure compressed air created by the release of a primed piston to communicate with the with the loaded dart. After the dart is launched an integral spring portion 160 biases the valve plate portion 158 forward to the closed position against the support ring 112 of the barrel portion 18. Of course, a newly loaded dart would push against the three fingers 152, 154, 156 and cause the valve plate portion to move rearward away from the support ring 112 to cause the barrel to again be opened. When closed, the valve plate portion 158 functions to block high-pressure air in the cylinder portion 16 of the outer body 12 from entering the barrel portion 18 forward of the flange ring 112. With the high-pressure air blocked, a launch is prevented. This arrangement prevents non-conforming objects, such as pencils, marbles or the like, from being launched from the inventive toy apparatus; hence, the safety valve and spring 22 is an important safety feature of the toy launcher 10.

Rearward of the valve plate portion 158 of the integral safety valve and spring is the integral spring portion 160, one end of which is integral with the valve plate portion 158 and the other end of which is integral with a base plate portion 162. The base plate portion 162 may include two spaced-apart parallel slot-like openings 164, 166 for engaging the valve cap 26 to prevent the safety valve and spring 22 from rotation in the barrel portion 18. It is noted that the safety valve and spring 22 is prevented from rotation at each end, namely, at the forward end by the fingers 152, 154, 156 engaged in the openings 116, 118, 120 of the Y-shaped element 114 of the outer body 12, and at the rearward end by the base plate portion 162 engaging the valve cap 26, as will be explained below.

The valve plate portion 158 of the safety valve and spring 22 may have a diameter of about 15 mm and the loops of the spring may have a diameter of about 1.25 mm. The two loops may have an extended length between the valve plate portion 158 and the base plate portion 162 of about 20.8 mm. The base plate portion 162 may also have a diameter of about 15 mm. The fingers 152, 154, 156 may each have a length of about 15.25 mm. It is to be noted that the dimensions of the fingers, the valve plate portion and the base plate portion may be scaled up or down as a function of the toy launcher size, the launcher model, the amount of friction needed, and/or the size of the dart to be discharged.

The advantages of the integral safety valve and spring are its low cost because it is molded as one piece, and the integral valve and spring enables quick and easy installation into the outer body.

Figure 16:
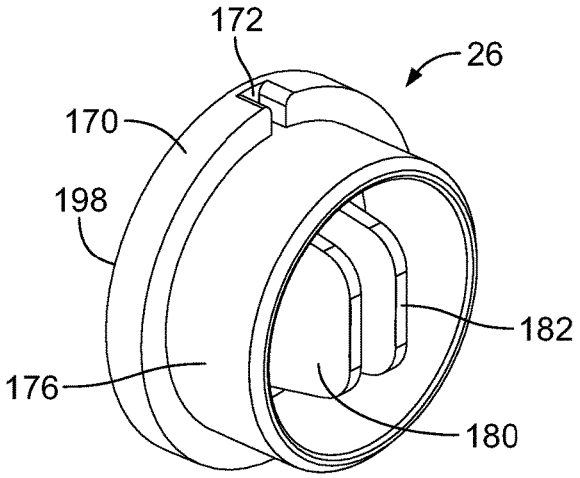
FIG. 16 is an enlarged isometric view of a valve cap of the launcher illustrated in FIGS. 1 and 2.

The valve cap 26, FIG. 16, is also generally cup-shaped with an outer flange 170 for engaging the rearward end 24 of the barrel portion 18. A notch 172 in the outer flange 170 is provided as an alignment feature for a key 174, FIGS. 2 and 12, on the outer body 12. A circular wall 176 extends forward from the outer flange 170 and encloses two tabs 180, 182 that are received by the two slots 164, 166 of the base plate portion 158 of the safety valve and spring 22 to help prevent rotation of the safety valve and spring. The valve cap may be attached to the barrel portion by adhesive, heat, or any other suitable arrangement. The circular wall 176 is slightly larger in diameter than the base plate portion 162 allowing the base plate portion to be seated in the valve cap 26. Alternative safety valves and springs may be used, as shown for example in FIGS. 33 and 34.

Figure 17:
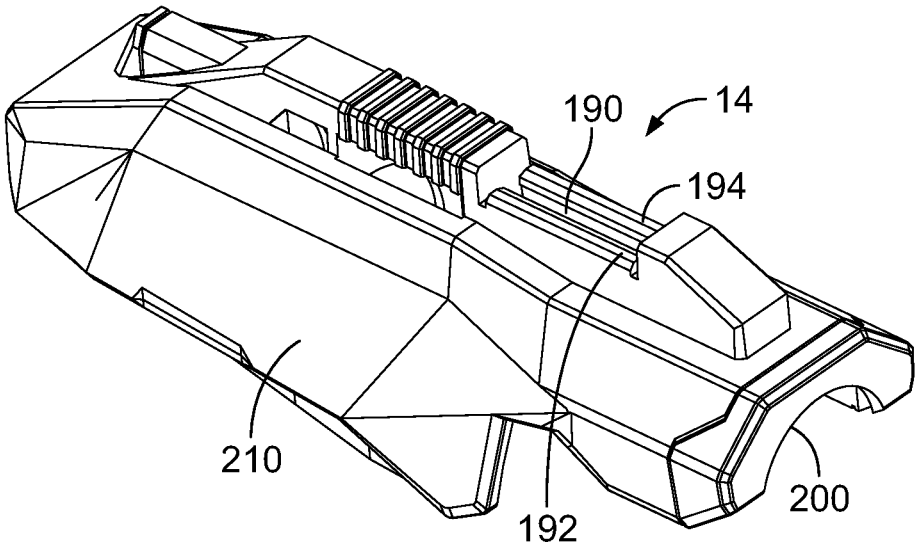
FIG. 17 is a downward-looking isometric view of a top shell of the launcher illustrated in FIGS. 1 and 2.
Figure 18:
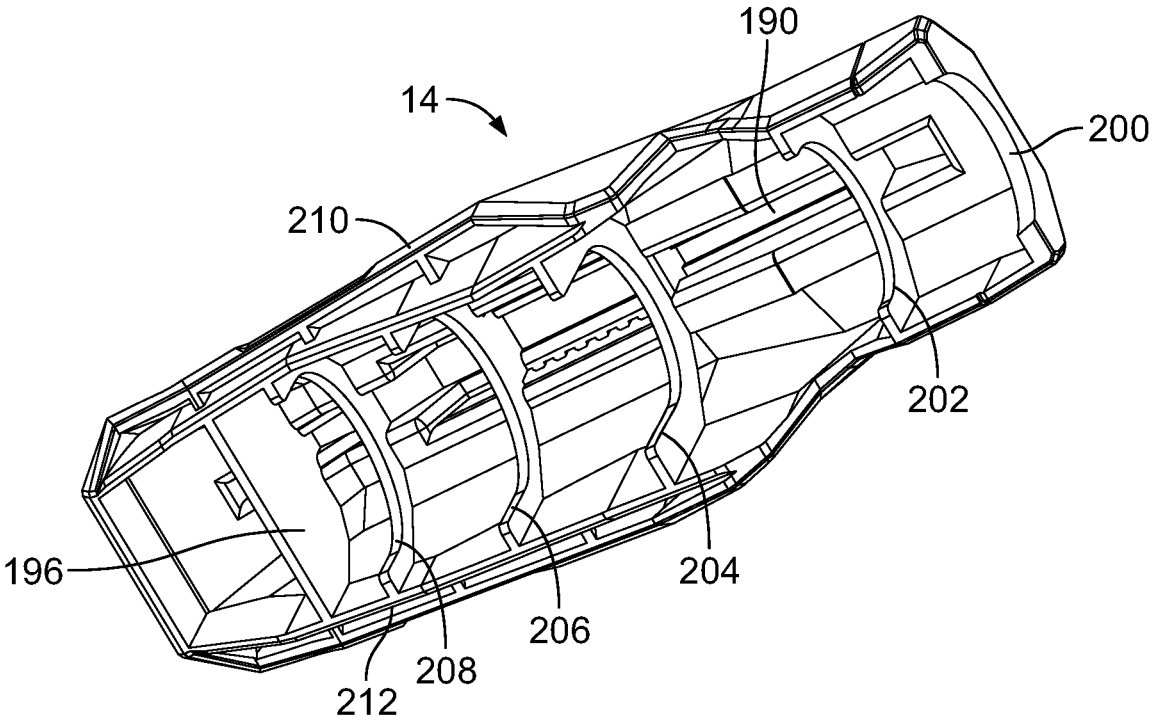
FIG. 18 is an upward-looking isometric view of the top shell illustrated in FIG. 18.

The top shell 14, FIGS. 17 and 18, may be included as a stylistic or decorative feature to cover the outer body 12 and includes an opening 190 flanked by two resilient arms 192, 194 that may receive the upper connector portion 98 of the outer body 12 in a snap-fit manner. The top shell 14 also includes a rear wall 196 for bearing against a rear surface 198, FIG. 16, of the valve cap 26. An additional five mounting panels 200, 202, 204, 206, 208, FIG. 18, are provided to reinforce side members 210, 212 of the top shell 14 and for cradling the barrel portion 18.

Figure 19:
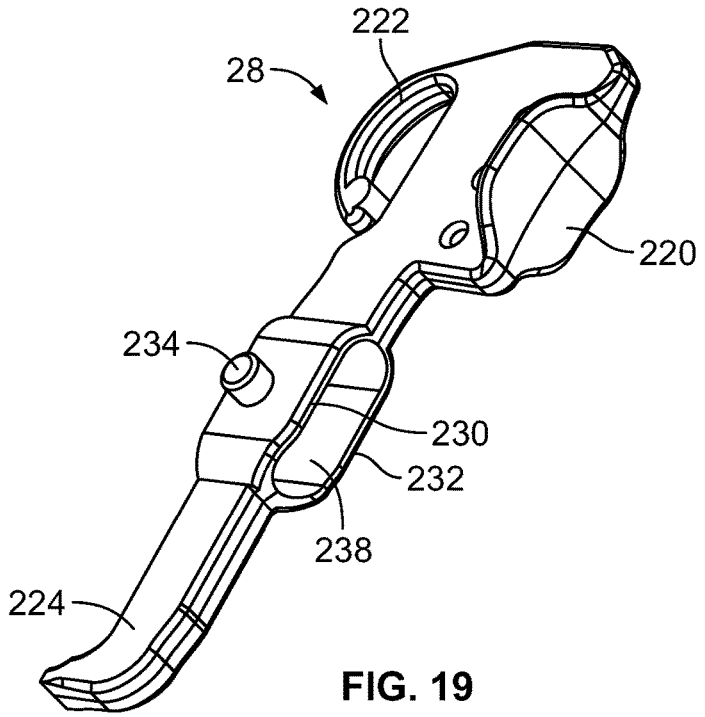
FIG. 19 is an enlarged front isometric view of the front of an integral trigger of the launcher illustrated in FIGS. 1 and 2.
Figure 21:
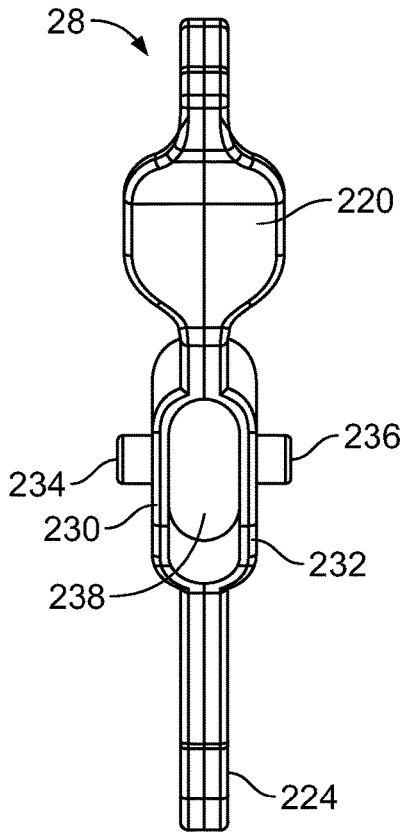
FIG. 21 is a front elevation view of the integral trigger illustrated in FIGS. 20 and 21.
Figure 20:
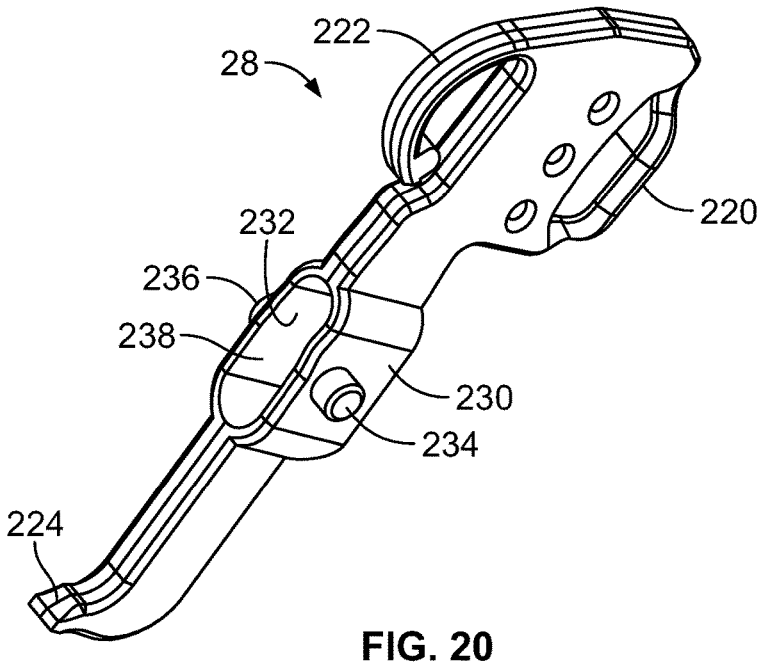
FIG. 20 is an isometric view of the rear of the integral trigger illustrated in FIG. 20.

The trigger 28, FIGS. 19-21, is also an integral part having four portions. At a forward, upper location is a finger pad portion 220 that is depressed by the user when the user desires to launch a dart. At a rearward, upper location is a curved, resilient spring arm portion 222 that flexes when the finger pad is depressed or pulled to create a biasing force to return the finger pad to its non-depressed position when the user's finger pressure is released. Helping to create the biasing force of the spring arm portion 222 is the ridge 123, FIG. 13, of the outer body, which the spring arm portion 222 bears against when the finger pad is depressed. At a lower portion of the trigger is a latch arm portion 224 that engages the ledge 81 of the recess 80, FIG. 8, of the piston 30 when the launch spring 32, FIG. 2, is compressed as the user pulls on the plunger rod 36 and the connected piston 30.

Between the upper and lower portions of the trigger is a pivot axis portion formed by two thin, resilient, spaced-apart legs 230, 232, FIGS. 19-21. Mounted to each of the legs 230, 232 is an integral short, outwardly extending, pivot shaft 234, 236. Each pivot shaft 234, 236 is received by a respective opening 104, 106, FIG. 13, in the panels 100, 102 of the outer body 12. Assembled, the trigger is shown in FIG. 1. An opening 238 separates the legs 230, 232 to form a box-like structure. This structure allows the thin legs 230, 232, and the pivot shafts 234, 236, to flex inward toward each other when squeezed during assembly. During assembly the pivot shafts ride in the grooves 103, 105 of the panels 100, 102 until the shafts are aligned with the panel openings 104, 106. When aligned, the shafts snap-fit with the panels and create a pivotal connection.

The NERF brand dart typically measures about 72 mm long with an outer diameter of about 12 mm. The actual dimensions of portions of the small toy dart launcher 10, which launches the NERF brand dart, may have a length for the barrel portion of about 80 mm and a mandrel length of about 35 mm. The sealing ring of the piston may be about 24 mm in diameter.

Figure 22:
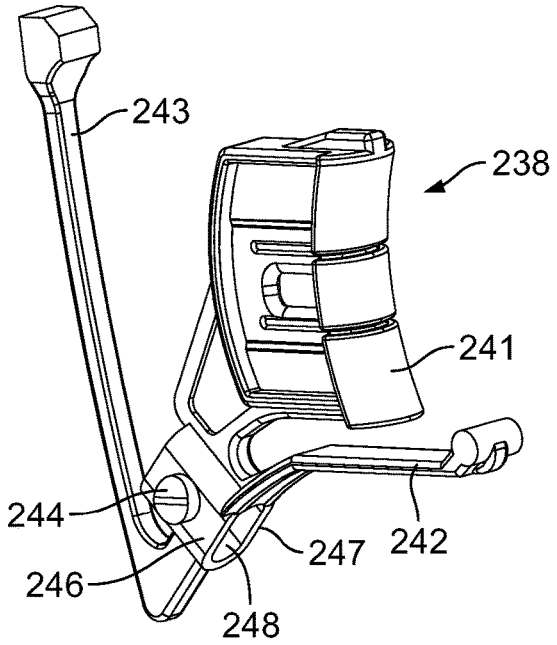
FIG. 22 is an isometric view of another embodiment of an integral trigger.
Figure 23:
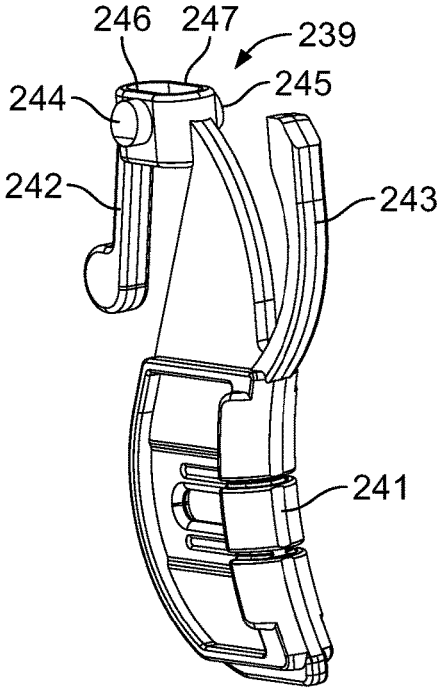
FIG. 23 is an isometric view of a yet another embodiment of an integral trigger.
Figure 24:
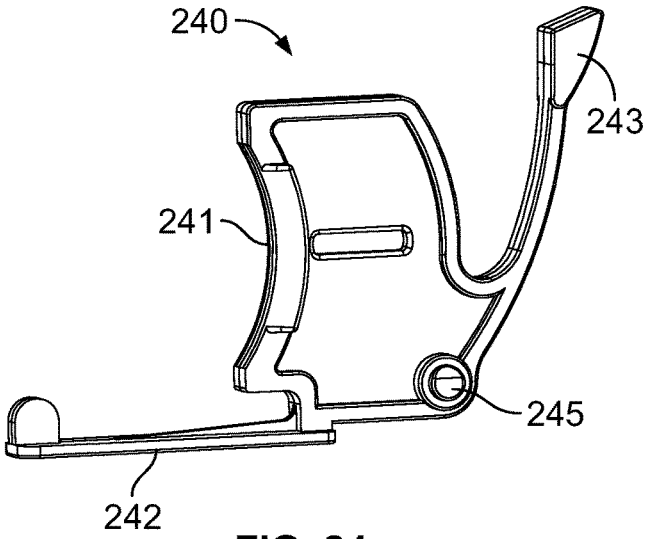
FIG. 24 is an isometric view of a further embodiment of an integral trigger.

Alternative triggers 238, 239 and 240 are illustrated in FIGS. 22-24. Like the trigger 28, the triggers 238, 239, 240 are each an integral component having a finger pad 241, a biasing spring 242, a latch arm 243, and pivot shafts 244, 245 on two thin legs 246, 247 separated by an opening 248. The triggers may be used in alternative launchers, such as those illustrated in FIGS. 25-30.

Figure 25:
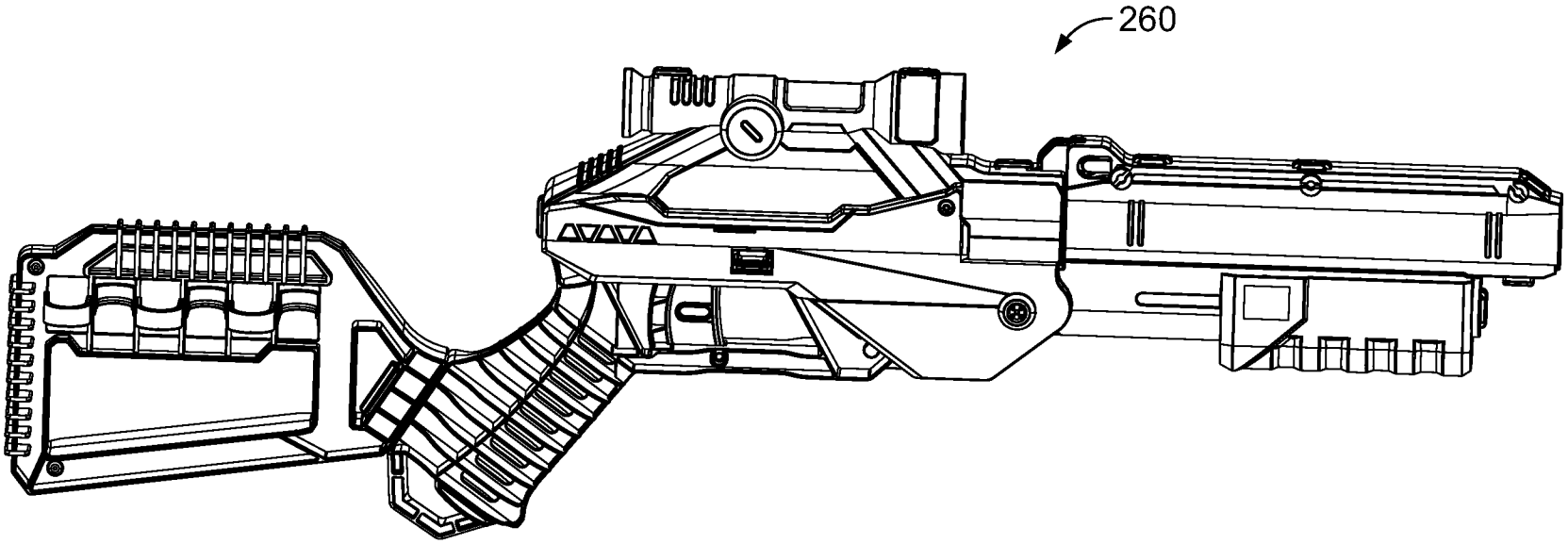
FIG. 25 is an elevation view of another embodiment of the inventive toy in the form of a simulated shotgun.
Figure 26:
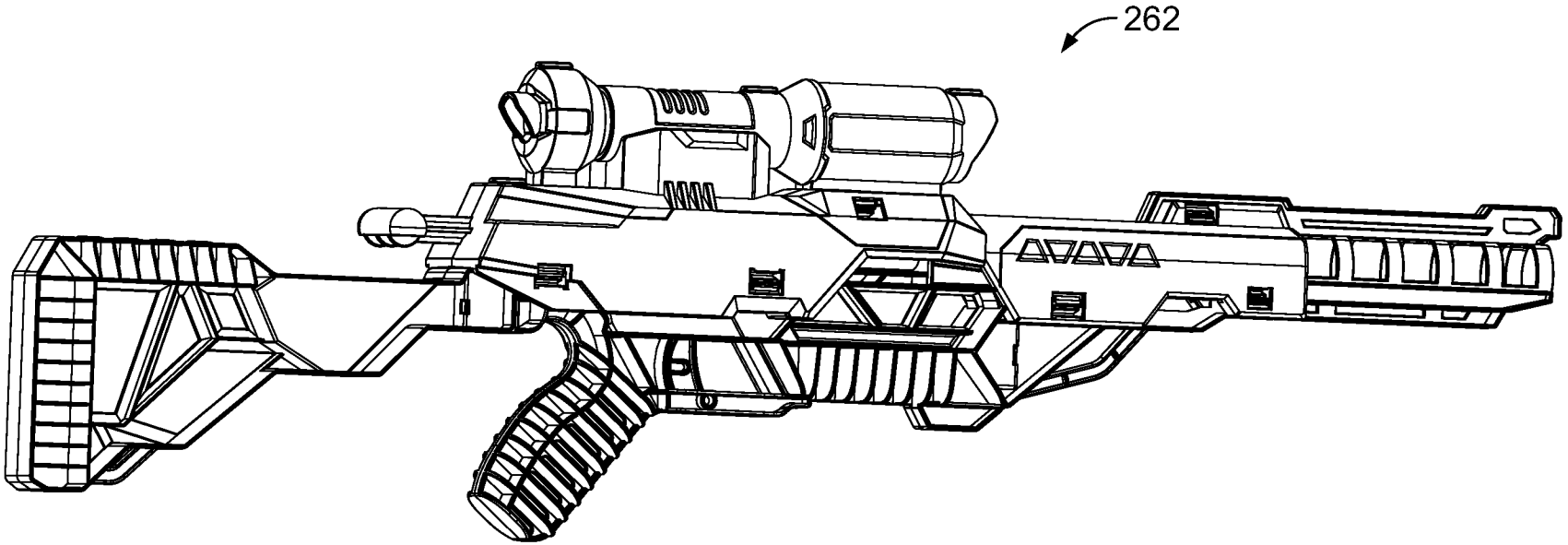
FIG. 26 is an isometric view of the inventive toy in the form of a simulated rifle.
Figure 27:
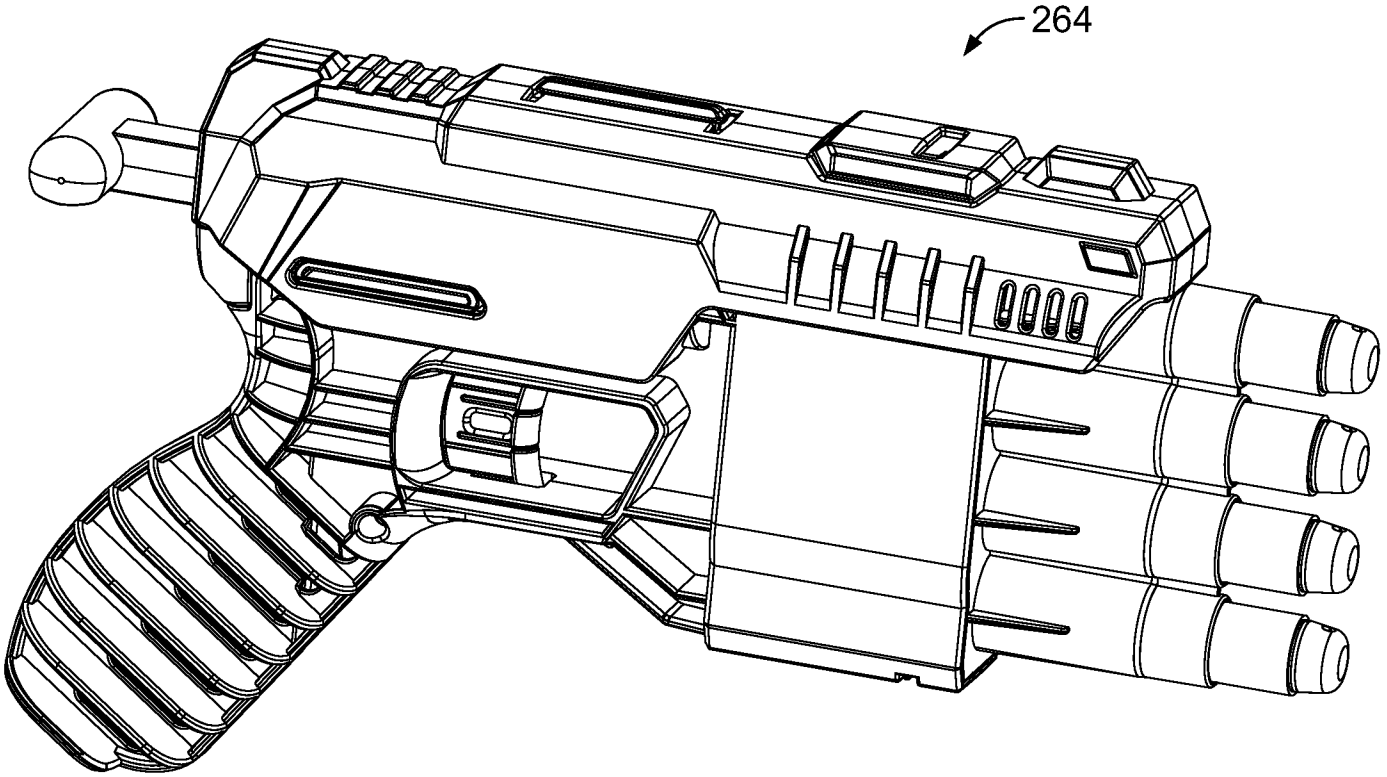
FIG. 27 is an isometric view of the inventive toy in the form of a simulated four-barrel gun.
Figure 28:
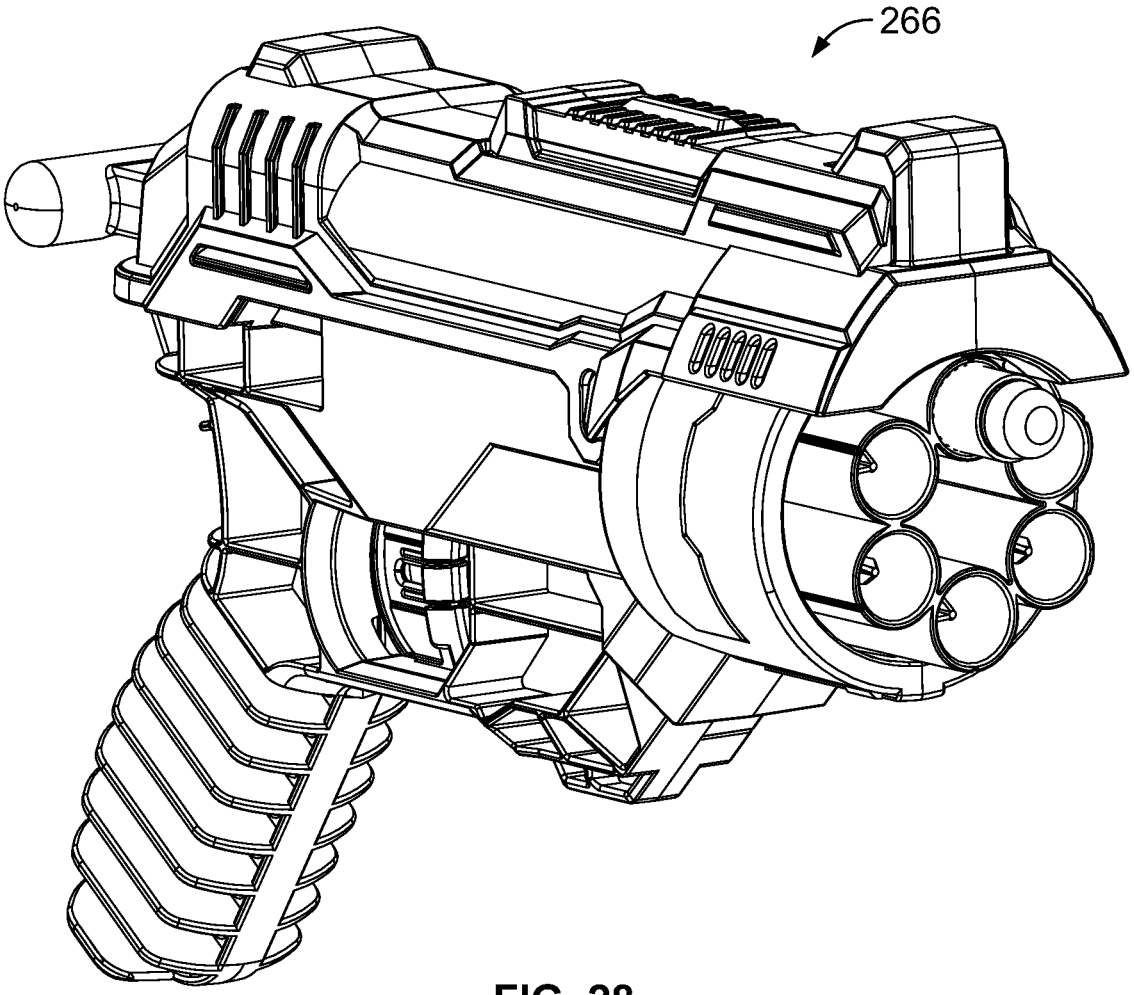
FIG. 28 is an isometric view of the inventive toy in the form of a simulated six-barrel gun.
Figure 29:
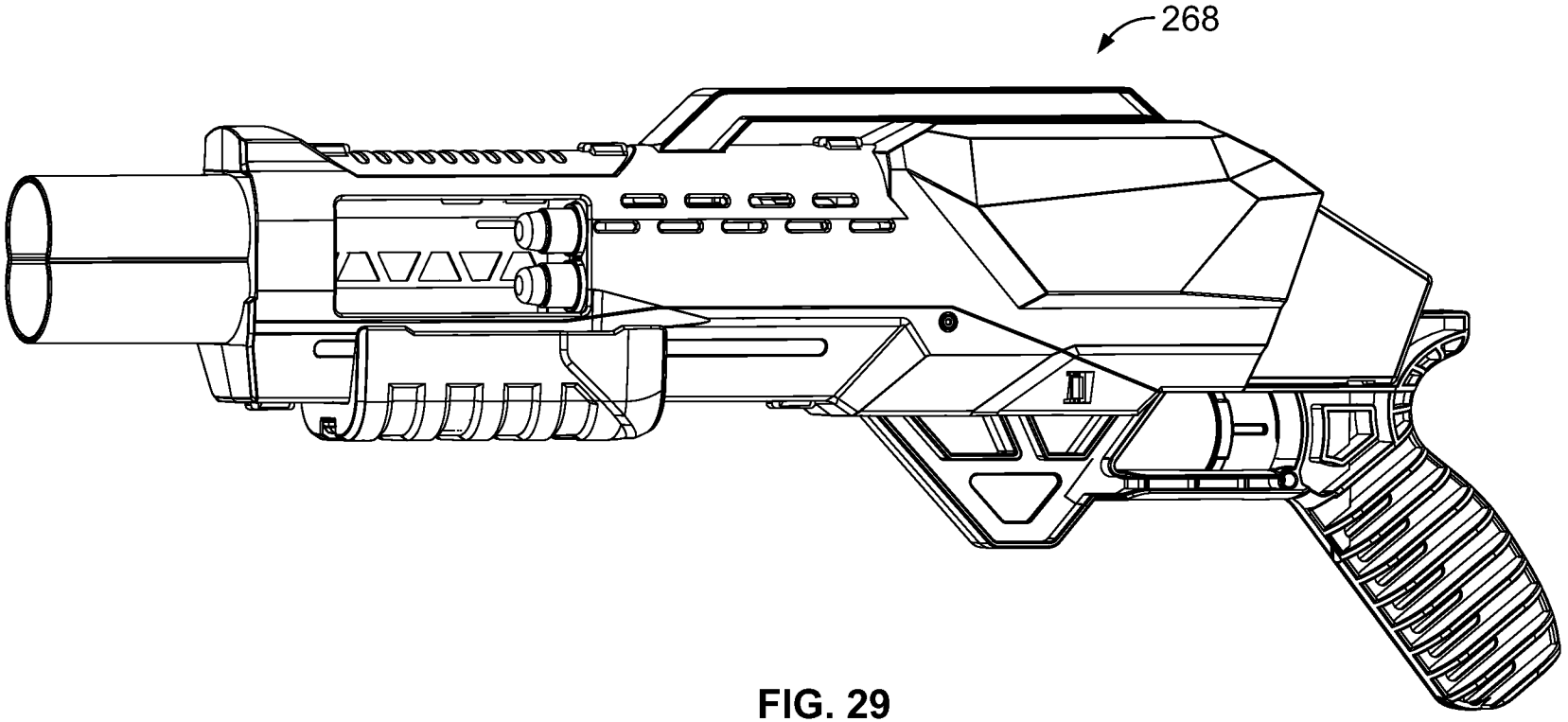
FIG. 29 is an isometric view of the inventive toy in the form of a simulated two-barrel shotgun.
Figure 30:
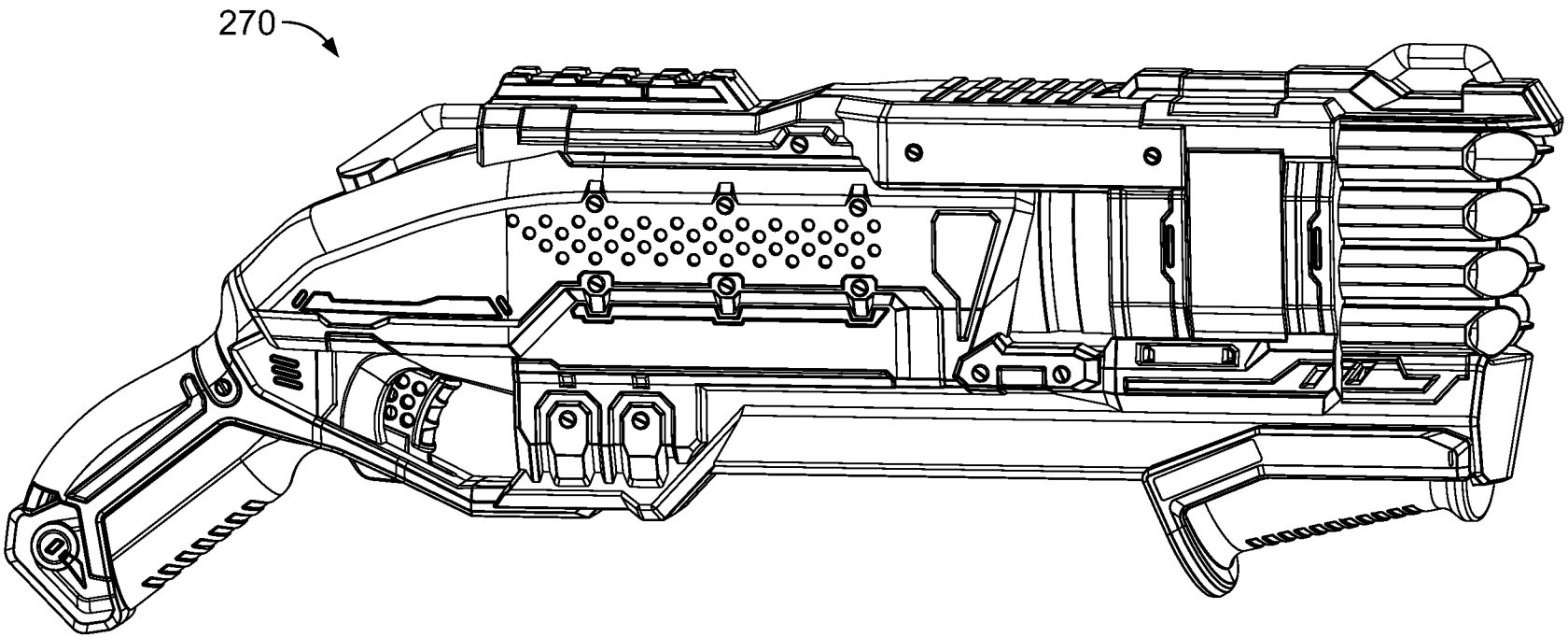
FIG. 30 is an isometric view of the inventive toy in the form of a simulated eight-barrel gun.

It is to be noted that the alternative launcher apparatus may include components similar to those described above. For example, the launcher 10, FIG. 1, is formed as a small, one-shot simulated gun. A simulated single barrel shotgun 260 is shown in FIG. 25, and a simulated single barrel rifle 262 is shown in FIG. 26. Other toy launcher apparatus come within the invention herein, such as multi-dart launchers. For example, a simulated four-barrel gun-like launcher 264 is illustrated in FIG. 27, a simulated six-barrel gun-like launcher 266 is illustrated in FIG. 28, a simulated two-barrel shotgun launcher 268 is illustrated in FIG. 29, and a simulated eight-barrel shotgun 270 is illustrated in FIG. 30. It is noted that priming of the launchers 262, 264, 266 is done in a generally horizontal direction by an operator pulling on a plunger rod, while launchers 260, 268, 270 are pump style apparatus with a priming handle under the barrel or barrels that is connected to plunger rods in the apparatus.

Figure 31:
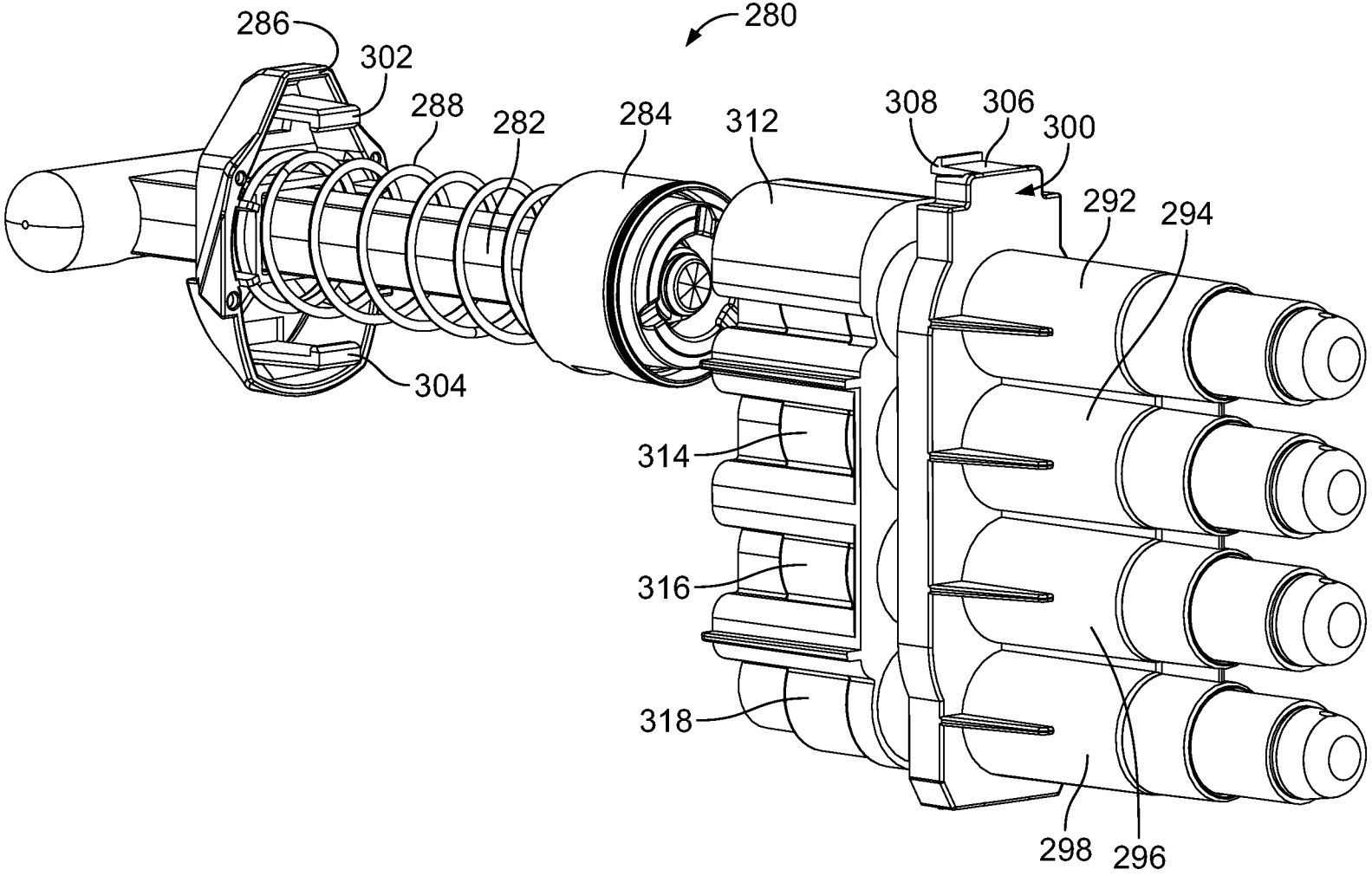
FIG. 31 is an isometric view of a sub-assembly including a plunger rod, a launch spring, and a piston, drawn in a horizontal disposition with a four-barrel assembly and another embodiment of the cylinder cap.
Figure 32:
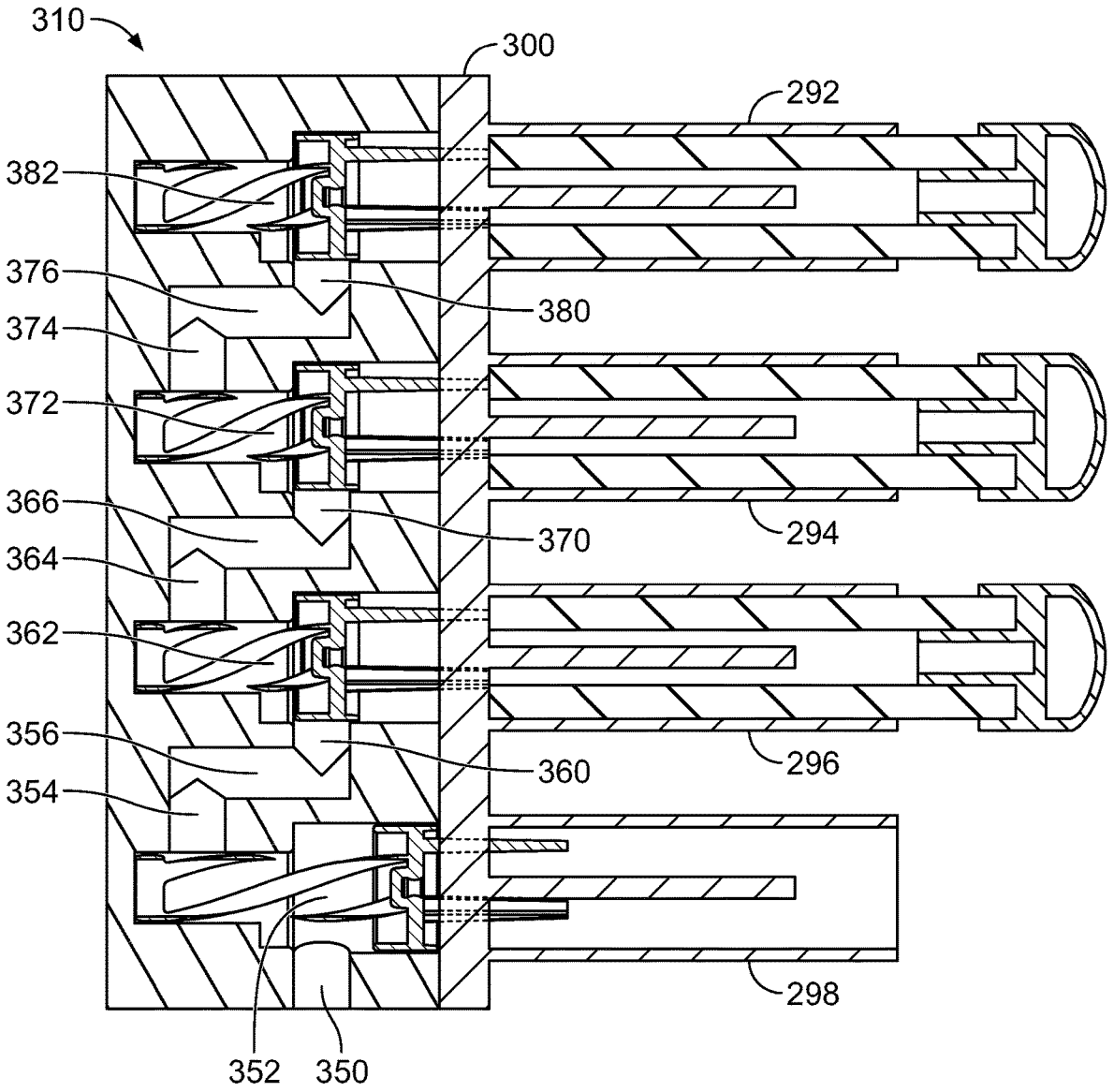
FIG. 32 is a sectional elevation view of a four-barrel assembly illustrating a cascading structure for directing high-pressure air generated by a sub-assembly similar to the sub-assembly shown in FIG. 31.

The structures of a plunger rod, a piston, and a valve as applied to launchers with multiple barrels, is best exemplified in FIGS. 31 and 32, where the firing mechanism is of a four-barrel launcher for example. A sub-assembly 280, including a plunger rod 282, a piston 284, a cylinder cap 286, and a launch spring 288 is illustrated (just like the plunger rod 36, FIG. 2, the piston 30, the cylinder cap 34, and the launch spring 32), along with four barrels 292, 294, 296, 298 where the barrels are stacked in a vertical alignment. Instead of the cap 34, FIGS. 1 and 2, being twisted onto the outer body 12, the cylinder cap 286 snap-fits onto a spike plate 300. The cylinder cap 286 includes resilient arms 302, 304 that flex over mating arms, such as the arm 306 of the plate 300, when the cap and plate are brought together in a snap-fit. After the arm 306 passes a protrusion 308 of the arm 306, the arm 306 returns to its original position. Both methods of attachment, twist and snap-fit, are quick and easy and have the advantage of saving assembly time. With plastic molded parts, the connector components are also very inexpensive, an additional advantage.

The sub-assembly illustrated in FIG. 31, may be scaled up or down in size and/or numbers, and in various geometries, such as in those launchers illustrated in FIGS. 27-30. To operate a multi-barrel launcher in an effective manner, the launchers use a cascade mechanism 310, FIG. 32, disclosed in detail in U.S. Pat. No. 8,567,378 and incorporated herein by reference, and described briefly here. The cascade mechanism 310 includes upstream cylinders 312, 314, 316, 318 that have a fixed air flow channel, the downstream barrels 292, 294, 296, 298 and the spike plate 300 between the cylinders and the barrels.

The cascade mechanism is extremely flexible, as mentioned, so that many alternative barrel arrangements may be configured while using only one sub-assembly of plunger, piston and launch spring. Examples are a circular barrel arrangement shown in FIG. 28, or the double column, eight barrel, arrangement shown in FIG. 30 (provided that the sub-assembly 280 is mounted in one of bottom cylinders instead of one of the top cylinders).

The high pressure air-flow in the cascade mechanism 310 starts with a first air inlet 350 at the bottom as depicted in FIG. 32, a first valve chamber 352, a first air outlet 354, and a first transfer tube 356. The first transfer tube 356 communicates with a second air inlet 360, a second valve chamber 362, a second air outlet 364, and a second transfer tube 366. The second transfer tube 366 communicates with a third air inlet 370 and from the third air inlet 370 to a third valve chamber 372, a third air outlet 374, a third transfer tube 376, a fourth air inlet 380, and a fourth valve chamber 382. It is noted that after all of the barrels are loaded with darts and after priming, high pressure air will only be able to move to the first valve chamber 352 to cause discharge of the lowest dart because a safety valve blocks the air from moving elsewhere. After discharge of the lowest dart, and after new priming, the high pressure air will be able to flow to the second valve chamber 362 to discharge the next lowest dart, after another priming, because the safety valve in the valve chamber 352 has been opened. Upon discharge of the second dart, a charge of the high pressure air, again after priming, will be able to move to the third valve chamber 372 to discharge the next dart. After discharge of the next dart, and after priming again, the high pressure air will be able to travel to the fourth valve chamber 382 to cause discharge of the top-most dart. The cascading effect may stop at two chambers or extend to eight or more as a function of the strength or spring rate of the launch spring 288.

It is also noted that the first air inlet 350 may be located elsewhere along the cascade mechanism.

Figure 33:
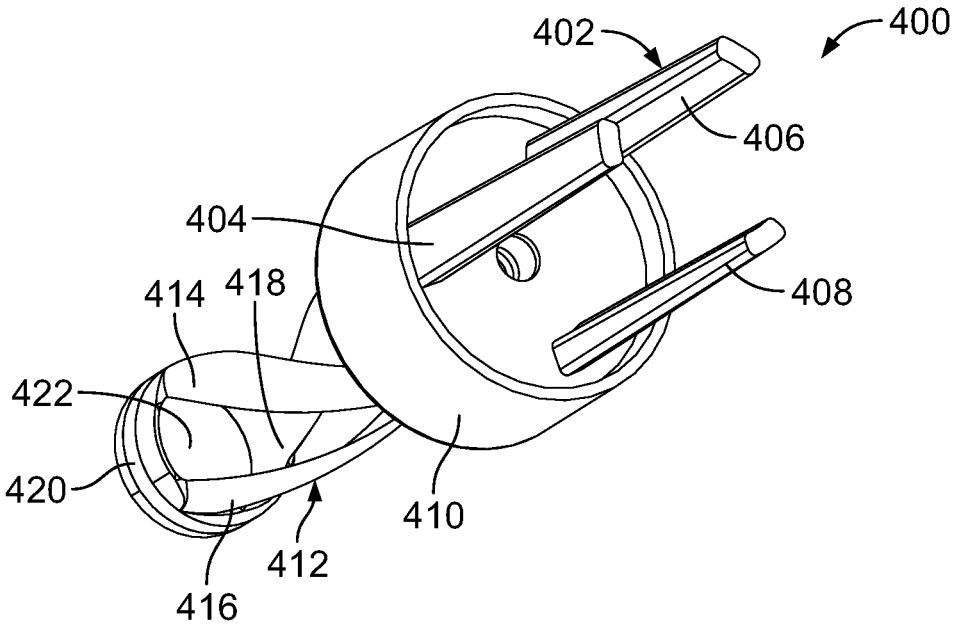
FIG. 33 is an isometric view of the front of another embodiment of an integral safety valve and spring.
Figure 34:
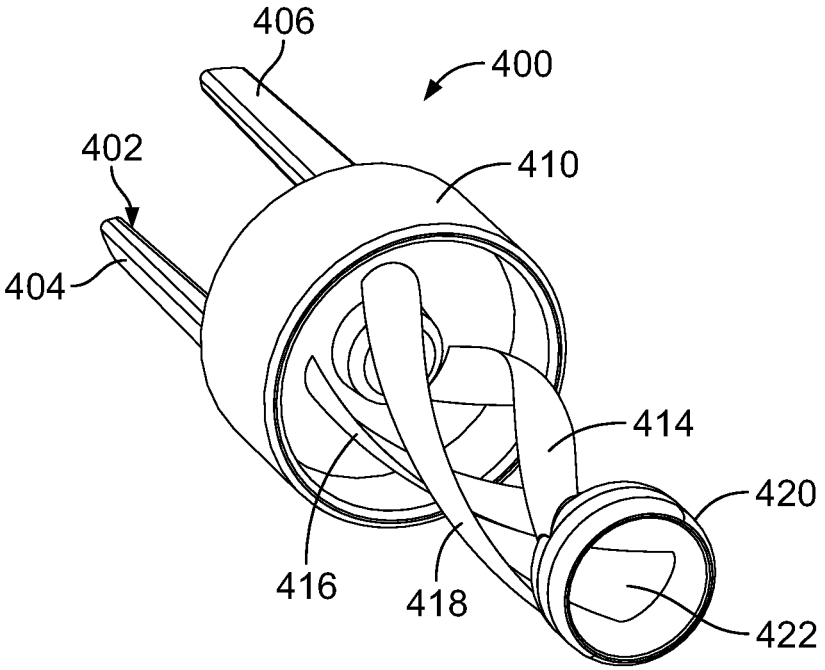
FIG. 34 is an isometric view of the rear of the integral safety valve and spring shown in FIG. 33.

An alternative safety valve and spring may be used with multi-barrel launchers for better airflow as well as with the single shot launcher 10. Referring now to FIGS. 33 and 34, the variation integral safety valve and spring 400 may include at a forward end, a dart contact portion 402 in the form of three fingers 404, 406, 408 to enable engagement with the rear wall 48, FIG. 3, of an loaded dart or other projectile. Rearward of the three fingers is a cup-shaped valve plate portion 410 that moves between forward/closed and rearward/open positions. After a dart corresponding to a valve and spring is launched, the integral spring portion 412 biases the valve plate portion 410 forward to the closed position as shown in the barrel 298, FIG. 32. The integral spring portion 412 is in the form of three twisted strips 414, 416, 418 that are integral at a forward end to the valve plate portion 410 and, at a rearward end, to a ring 420 such that high pressure air may flow around and between the twisted strips 414, 416, 418 and through an opening 422 in the ring 420.

As consistent with the toy launcher 10, the toy launchers 260, 262, 264, 266, 268, 270 are simply constructed, structurally robust and easily assembled, even though some launchers may have more than eight parts. Nevertheless, when compared to previous toy multi-dart launchers, rifle type launchers and shotgun type launchers, shown in FIGS. 26-30, the bigger launchers will still use fewer parts and take less time to assemble than their predecessors.

It is noted that throughout this detailed description, words such as "forward," "rearward," "upper," "lower," "front," "rear," "top" and "bottom," as well as similar positional terms, refer to portions or elements of the launcher as they are viewed in the drawings, or in relationship to the positions of the apparatus as it will typically be deployed and moved during use, or to movements of elements based on the configurations illustrated.

In operation of the launcher apparatus 10, a user may manually insert a dart over the mandrel in the barrel. Insertion of the dart will open the safety valve and spring because the dart has the proper configuration to bear against the safety valve's extending fingers. Other objects differently configured will not push the safety valve open. The user then grips the handle of the plunger with two fingers and pulls the plunger rod downward or rearward, depending upon the model of the launcher. Or, if of a shotgun design, an under-barrel handle is rearward. Pulling on the handle/plunger rod will compress the launch spring until the latch arm of the trigger engages and holds the ledge of the piston. Thereafter, when the user pulls back the pad of the trigger, the toy apparatus launches the dart.

In operation of a multi-barrel launcher, after priming once and pulling a trigger, a dart will be launched. After priming again, the high pressure air will cascade to the next valve chamber in turn and be available to launch another dart.

Figure 35:
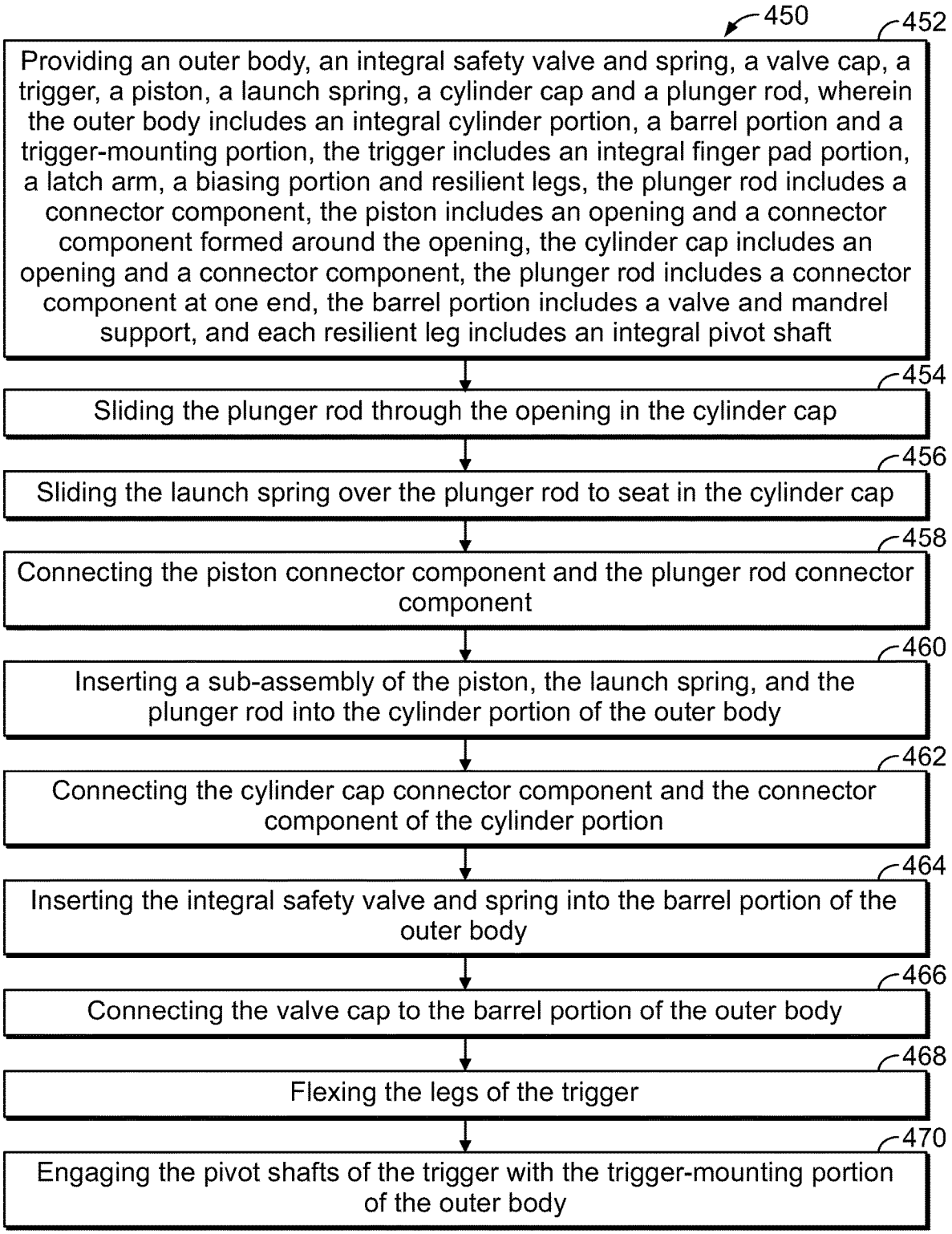
FIG. 35 is a flow diagram of a method for assembling the inventive toy launcher.

The present invention includes a method 450, FIG. 35, for assembling the inventive toy launcher 10. The method for the assembly of the dart launcher includes the steps of providing an outer body, an integral safety valve and spring, a valve cap, a trigger, a piston, a launch spring, a cylinder cap and a plunger rod, wherein the outer body includes an integral cylinder portion, a barrel portion and a trigger-mounting portion, the trigger includes an integral finger pad portion, a latch arm, a biasing portion and resilient legs, the plunger rod includes a connector component, the piston includes an opening and a connector component formed around the opening, the cylinder cap includes an opening and a connector component, the plunger rod includes a connector component at one end, the barrel portion includes a valve and mandrel support, and each resilient leg includes an integral pivot shaft 452; sliding the plunger rod through the opening in the cylinder cap 454; sliding the launch spring over the plunger rod to seat in the cylinder cap 456; connecting the piston connector component and the plunger rod connector component 458; inserting a sub-assembly of the piston, the launch spring, and the plunger rod into the cylinder portion of the outer body 460; connecting the cylinder cap connector component and the connector component of the cylinder portion 462; inserting a sub-assembly of the piston, the launch spring, and the plunger rod into the cylinder portion of the outer body 464; connecting the valve cap to the barrel portion of the outer body 466; flexing the legs of the trigger 468; and engaging the pivot shafts of the trigger with the trigger-mounting portion of the outer body 470.

It is to be noted that no screws or other fastener hardware are used to assemble the toy launcher 10, and that no O-ring is required. With integral parts, the assembly process is quick and easy and relatively inexpensive. The result is a well-constructed, robust structure.

Figure 36:
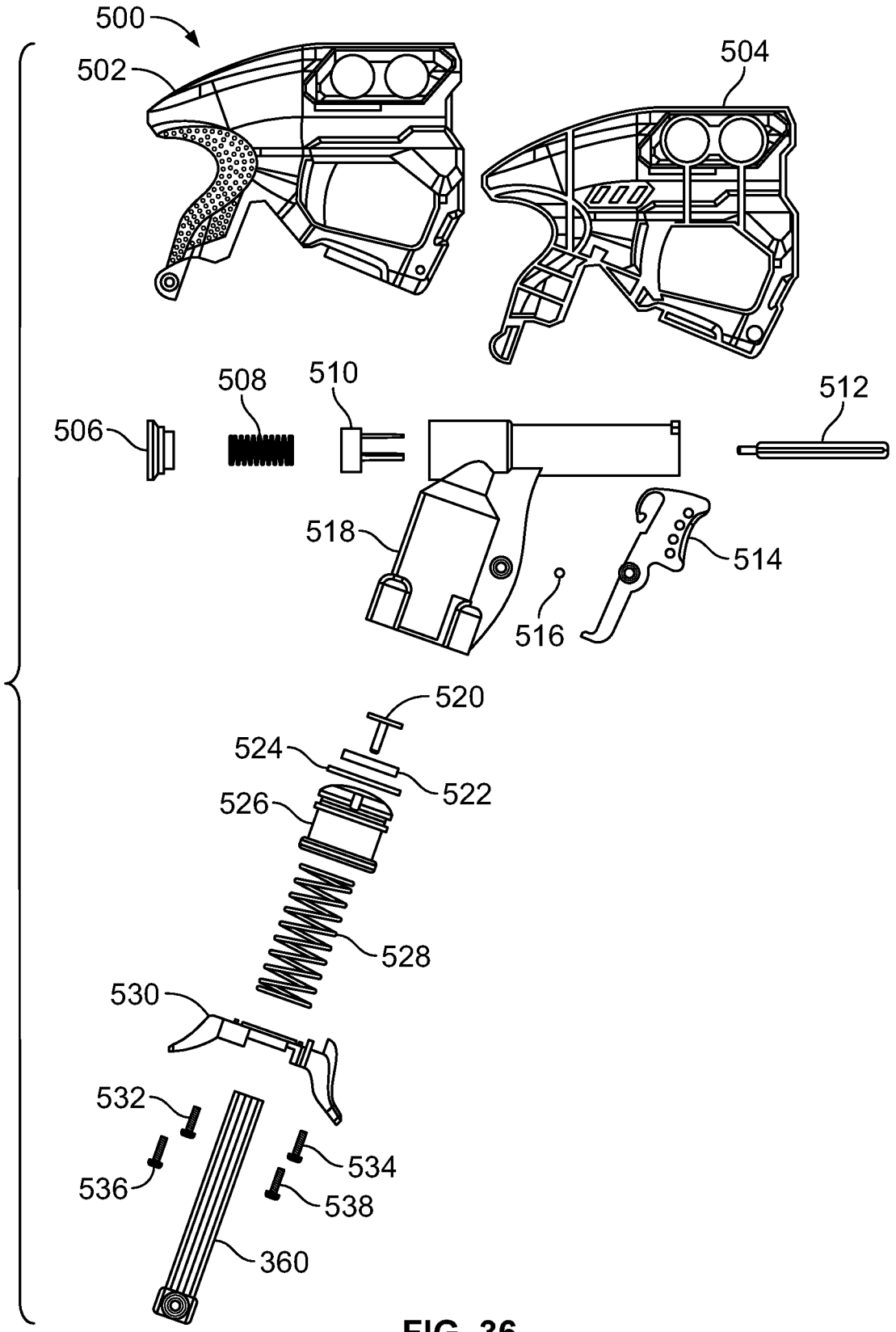
FIG. 36 is an exploded elevation view of a previous launcher apparatus.

Referring now to FIG. 36, there is shown an example of a previous toy dart launcher 500 for comparison with the dart launcher 10. The previous dart launcher 500 includes a left half shell 502, a right half shell 504, a valve cap 506, a separate valve spring 508, a separate safety valve 510, a separate mandrel or spike 512, a trigger 514, a trigger pivot pin 516, a body 518, a piston pin 520, a piston pad 522, an O-ring 524, a piston 526, a compression launch spring 528, a cylinder cap 530, four cap screws 532, 534, 536, 538, and a plunger rod 540. In comparison with the launcher 10 (depending upon whether the top shell 14 is included), the previous launcher 500 includes some twenty parts verses only eight or nine parts in the inventive launcher 10, hence there is a substantial savings gained with the inventive launcher in that there are less parts and yet the inventive launcher is functionally equivalent to the previous launcher.

There is also a greater efficiency gain during assembly of the inventive launchers. Reducing the cost of assembly is also a major benefit of the inventive launcher. The steps in assembling the previous launcher include providing the twenty parts for the previous launcher, sliding the O-ring over the piston, sliding the plunger rod through the cylinder cap, sliding the compression spring over the plunger rod, pinning the piston pad to the piston, inserting the piston and spring sub-assembly into the main body, connecting the four screws through the cap to the body (four steps), press-fitting the mandrel to the body, inserting the safety valve into the body, inserting the safety valve spring into the body, adhering the valve cap to the body, placing the trigger in the body, press fitting the pin through the body and the trigger, placing the assembly into the left shell, placing the right shell over the left shell, and adhering the shells together. The assembly process for creating the previous launcher includes eighteen steps in comparison to only nine steps for assembling the inventive toy launcher 10, a major improvement for the launcher 10.

It has been estimated that there is a range of savings of between about 8 and 60% in part costs and a range of savings of about 30 to 41% in assembly time.

The disclosed toy launcher apparatus and methods may further include the safety valve and spring including an integral dart contacting extender portion, a valve plate portion, a spring portion and a base portion; and The spring portion includes a wave shaped spring with one end of the spring integral with the valve plate portion and an opposite end integral with the base portion; and including the step of: Supporting the extender portion of the safety valve and spring by the valve and mandrel support of the barrel portion.

The safety valve and spring includes an integral dart contacting extender portion in the form of three fingers, a cup-shaped valve plate portion, a spring portion and a base portion, the spring portion including a plurality of twisted strips with one end of each strip being integral with the valve plate portion and an opposite end of each strip being integral with the base portion; and including the step of: Supporting the extender portion by the valve and mandrel support of the barrel portion. An outer body having an integral cylinder portion, a barrel portion and a trigger-mounting portion, the barrel portion including a valve and mandrel support; a safety valve and spring having an integral dart contact portion, a valve plate portion, a spring portion and a base portion, the spring portion being integral with the valve plate portion at one end and the base portion at an opposite end, the safety valve and spring being mounted in the barrel portion of the outer body and supported by the valve and mandrel support, the safety valve and spring for engaging a dart loaded in the barrel portion; a valve cap secured to the barrel portion of the outer body; a trigger having an integral finger pad portion, a latch arm portion, a biasing spring portion, and a pivotal mounting portion, the pivotal mounting including opposing pivot shafts, each pivot shaft mounted on a resilient leg, the trigger being pivotally connected to the trigger-mounting portion of the outer body; a cylinder cap having an opening and a connector component, the opening for supporting a slideable plunger rod and the connector component for connecting to an connector component of the cylinder portion of the outer body; a plunger rod having a handle at one end and a connector component at an opposite end, the plunger rod extending through the opening of the cylinder cap; a piston with an opening and a connector component around the opening, the connector component of the piston to enable the piston to connect with the connector component of the plunger rod; and a launch spring mounted around the plunger rod, the launch spring being seated between the cylinder cap and the piston.

The dart contact portion of the safety valve and spring includes a plurality of extending legs, the legs being supported by the valve and mandrel support of the barrel portion of the outer body; the valve plate portion cup shaped; the spring portion includes a plurality of twisted strips with one end of each strip being integral with the valve plate portion and an opposite end of each strip being integral with the base portion; and the base portion is a ring. The pivot shafts are integral with the legs; the resilient legs on which the pivot shafts are mounted are spaced apart and flex toward each other during assembly of the launcher apparatus; and the pivot shafts move inward with the legs.

It may now be appreciated that the toy apparatus disclosed in detail above has great entertainment value, is fun to use and easy to operate. The toy apparatus is compact, lightweight and yet robust, and has a simple structure that may be produced at a substantial cost savings.

From the foregoing, it can be seen that there has been provided a detailed description and features for an improved toy apparatus as well as a disclosure of a method for assembling the toy apparatus. While particular embodiment of the present invention has been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launcher apparatus comprising:

an outer body having an integral cylinder portion, a barrel portion and a trigger-mounting portion, the barrel portion including a valve and mandrel support;

a safety valve and spring having an integral dart contacting portion, a valve plate portion, a spring portion and a base portion, the safety valve and spring being mounted in the barrel portion of the outer body and supported by the valve and mandrel support, the safety valve and spring being movable by a dart loaded in the barrel portion;

a valve cap secured to the barrel portion of the outer body;

a trigger having an integral finger pad portion, a latch arm portion, a biasing spring portion, and opposing pivot shafts mounted on resilient legs, the trigger being pivotally connected to the trigger-mounting portion of the outer body;

a cylinder cap having an opening for a plunger rod and a connector component for engaging a connector component of the cylinder portion of the outer body;

a plunger rod having a handle at one end and a connector component at an opposite end, the plunger rod extending through the opening of the cylinder cap;

a piston with an opening and a connector component around the opening, the connector component of the piston to enable the piston to interlock with the connector component of the plunger rod; and a launch spring mounted around the plunger rod, the launch spring being seated between the cylinder cap and the piston.

2. The toy launcher apparatus claimed in claim 1, wherein:

the dart contact portion of the safety valve and spring includes an extender supported by the valve and mandrel support of the barrel portion of the outer body;

the valve plate portion is cup shaped; and the spring portion is wave shaped with one end integral with the valve plate portion and an opposite end integral with the base portion.

3. The toy launcher apparatus claimed in claim 2, wherein:

the valve cap includes a tab; and the base portion of the safety valve and spring includes a slot for receiving the tab of the valve cap.

4. The toy launcher apparatus claimed in claim 1, wherein:

the dart contact portion of the safety valve and spring includes an extender supported by the valve and mandrel support of the barrel portion of the outer body; and the spring portion of the safety valve and spring includes a plurality of twisted strips, each strip having one end integral with the valve plate portion and an opposite end integral with the base portion.

5. The toy launcher apparatus claimed in claim 4, wherein:

the valve plate portion is cup shaped; and the base portion is ring shaped.

6. The toy launcher apparatus claimed in claim 1, wherein:

the pivot shafts are integral with the legs;

the resilient legs on which the pivot shafts are mounted are spaced apart and flex toward each other during assembly of the launcher apparatus; and the pivot shafts move inward with the legs.

7. The toy launcher apparatus claimed in claim 6, wherein:

the trigger-mounting portion of the outer body includes two spaced-apart panels;

each panel includes an opening for receiving a pivot shaft of the trigger; and each panel includes a groove from a front edge of the arm panel to the opening.

8. The toy launcher apparatus claimed in claim 1, wherein:

the piston includes a recess and a ledge to enable engagement with the latch arm portion of the trigger.

9. The toy launcher apparatus claimed in claim 1, wherein:

the dart contact portion of safety valve and spring includes an extender supported by the valve and mandrel support of the barrel portion of the outer body;

the valve plate portion is cup shaped; and the spring portion is integral at one end with the valve plate portion and at an opposite end integral with the base portion.

10. The toy launcher apparatus claimed in claim 9, wherein:

the valve cap includes a tab;

the base portion include a slot for receiving the tab of the valve cap; and the spring portion includes a wave shaped spring.

11. The toy launcher apparatus claimed in claim 10, wherein:

the spring portion of the safety valve and spring includes a plurality of twisted strips, the strips having one end integral with the valve plate portion and an opposite end integral with the base portion; and the base portion is ring shaped.

12. The toy launcher apparatus claimed in claim 11, wherein:

the pivot shafts are integral with the legs;

the resilient legs on which the pivot shafts are mounted are spaced apart and flex toward each other during assembly of the launcher apparatus; and the pivot shafts move inward with the legs.

13. The toy launcher apparatus claimed in claim 10, wherein:

the trigger-mounting portion of the outer body includes two spaced-apart panels;

each panel includes an opening for receiving a pivot shaft of the trigger; and each panel includes a groove from a front edge of the arm panel to the opening.

14. The toy launcher apparatus claimed in claim 11, wherein:

the piston includes a recess and a ledge to enable engagement with the latch arm portion of the trigger.

15. A method for assembling a toy launcher apparatus including the steps of:

providing an outer body, an integral safety valve and spring, a valve cap, a trigger, a piston, a launch spring, a cylinder cap and a plunger rod, wherein the outer body includes an integral cylinder portion, a barrel portion and a trigger-mounting portion, the trigger includes an integral finger pad portion, a latch arm, a biasing portion and resilient legs, the plunger rod includes a connector component, the piston includes an opening and a connector component formed around the opening, the cylinder cap includes an opening and a connector component, the plunger rod includes a connector component at one end, the barrel portion includes a valve and mandrel support, and each resilient leg includes an integral pivot shaft;

sliding the plunger rod through the opening in the cylinder cap;

sliding the launch spring over the plunger rod to seat in the cylinder cap;

connecting the piston connector component and the plunger rod connector component;

inserting a sub-assembly of the piston, the launch spring, and the plunger rod into the cylinder portion of the outer body;

connecting the cylinder cap connector component and the connector component of the cylinder portion;

inserting the integral safety valve and spring into the barrel portion of the outer body;

connecting the valve cap to the barrel portion of the outer body;

flexing the legs of the trigger; and engaging the pivot shafts of the trigger with the trigger-mounting portion of the outer body.

16. The method claimed in claim 15 wherein:

the safety valve and spring includes an integral dart contacting extender portion, a valve plate portion, a spring portion and a base portion; and the spring portion includes a wave shaped spring with one end of the spring integral with the valve plate portion and an opposite end integral with the base portion; and including the step of:

supporting the extender portion of the safety valve and spring by the valve and mandrel support of the barrel portion.

17. The method claimed in claim 15 wherein:

the safety valve and spring includes an integral dart contacting extender portion in the form of three fingers, a cup-shaped valve plate portion, a spring portion and a base portion, the spring portion including a plurality of twisted strips with one end of each strip being integral with the valve plate portion and an opposite end of each strip being integral with the base portion; and including the step of:

supporting the extender portion by the valve and mandrel support of the barrel portion.

18. A toy launcher apparatus comprising:

an outer body having an integral cylinder portion, a barrel portion and a trigger-mounting portion, the barrel portion including a valve and mandrel support;

a safety valve and spring having an integral dart contact portion, a valve plate portion, a spring portion and a base portion, the spring portion being integral with the valve plate portion at one end and the base portion at an opposite end, the safety valve and spring being mounted in the barrel portion of the outer body and supported by the valve and mandrel support, the safety valve and spring for engaging a dart loaded in the barrel portion;

a valve cap secured to the barrel portion of the outer body;

a trigger having an integral finger pad portion, a latch arm portion, a biasing spring portion, and a pivotal mounting portion, the pivotal mounting including opposing pivot shafts, each pivot shaft mounted on a resilient leg, the trigger being pivotally connected to the trigger-mounting portion of the outer body;

a cylinder cap having an opening and a connector component, the opening for supporting a slideable plunger rod and the connector component for connecting to an connector component of the cylinder portion of the outer body;

a plunger rod having a handle at one end and a connector component at an opposite end, the plunger rod extending through the opening of the cylinder cap;

a piston with an opening and a connector component around the opening, the connector component of the piston to enable the piston to connect with the connector component of the plunger rod; and a launch spring mounted around the plunger rod, the launch spring being seated between the cylinder cap and the piston.

19. The toy launcher apparatus claimed in claim 18, wherein:

the dart contact portion of the safety valve and spring includes a plurality of extending legs, the legs being supported by the valve and mandrel support of the barrel portion of the outer body;

the valve plate portion is cup shaped;

the spring portion includes a plurality of twisted strips with one end of each strip being integral with the valve plate portion and an opposite end of each strip being integral with the base portion; and the base portion is a ring.

20. The toy launcher apparatus claimed in claim 19, wherein:

the pivot shafts are integral with the legs;

the resilient legs on which the pivot shafts are mounted are spaced apart and flex toward each other during assembly of the launcher apparatus; and the pivot shafts move inward with the legs.

* * * * *